US006999055B2

(12) United States Patent
Yamashita et al.

(10) Patent No.: US 6,999,055 B2
(45) Date of Patent: Feb. 14, 2006

(54) DISPLAY DEVICE

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 19 days.

(21) Appl. No.: 10/492,146

(22) PCT Filed: Oct. 16, 2002

(86) PCT No.: PCT/JP02/10757

§ 371 (c)(1),
(2), (4) Date: Apr. 9, 2004

(87) PCT Pub. No.: WO03/034395

PCT Pub. Date: Apr. 24, 2003

(65) Prior Publication Data

US 2005/0018107 A1 Jan. 27, 2005

(30) Foreign Application Priority Data

Oct. 17, 2001 (JP) ..... 2001-319264

(51) Int. Cl.
*G09G 3/36* (2006.01)

(52) U.S. Cl. ..... 345/98; 345/99

(58) Field of Classification Search ..... 345/87, 345/89, 94, 98, 99, 100, 213
See application file for complete search history.

(56) References Cited

U.S. PATENT DOCUMENTS 5,200,925 A * 4/1993 Morooka ..... 365/219
6,862,015 B1 * 3/2005 Fujioka et al. ..... 345/98
6,894,673 B1 * 5/2005 Koga et al. ..... 345/99
2001/0054997 A1 * 12/2001 Fujioka et al. ..... 345/87
2003/0011557 A1 * 1/2003 Koga et al. ..... 345/99
2003/0038795 A1 * 2/2003 Uchino et al. ..... 345/213
2004/0046727 A1 * 3/2004 Fujioka et al. ..... 345/98

FOREIGN PATENT DOCUMENTS

JP 11-65536 A 3/1999
JP 2000-267616 A 9/2000
JP 2001-215928 A 8/2001

* cited by examiner

*Primary Examiner*—Amare Mengistu
(74) *Attorney, Agent, or Firm*—Robert J. Depke; Trexler, Bushnell, Giangiorgi, Blackstone & Marr, Ltd.

(57) ABSTRACT

An object of the present invention is to suppress occurrence of vertical streaks and ghosts by realizing complete non-overlap sampling in execution of horizontal driving by a clock drive method.

A horizontal driving circuit (17) has a shift register capable of performing a shift operation synchronously with a first clock signal HCK and outputting shift pulses sequentially from respective shift stages thereof; a first switch group for extracting a second clock signal DCK in response to the shift pulses; and a second switch group for sequentially sampling an input video signal in response to the second clock signal DCK extracted by the switches of the first switch group, and supplying the sampled signal to each signal line (12). An external clock generating circuit (18) is provided outside a panel (33) and supplies the second clock signal DCK externally. Further an internal clock generating circuit (19) is formed in the panel (33) and supplies the first clock signal HCK to the horizontal driving circuit (17) in accordance with the second clock signal DCK.

8 Claims, 27 Drawing Sheets

(1)

(2)

DISPLAY DEVICE

This application claims priority to Japanese Patent Application Number JP2001-319264, filed Oct. 17, 2001, and Japanese Patent Application Number JP2001-319265, filed Oct. 17, 2001, which are incorporated herein by reference.

TECHNICAL FIELD

The present invention relates to a display device, and more particularly to an active matrix type display device based on a dot sequential driving system adopting a clock drive method in its horizontal driving circuit. The invention further relates to a dot sequential driving type active matrix display device where a clock drive method is applied to its horizontal driving circuit of a divided sample-and-hold system.

BACKGROUND ART

In a display device such as, for example, an active matrix type liquid crystal display device using liquid crystal cells as pixel display elements (electro-optical elements), there is known a dot sequential driving type horizontal driving circuit of a structure employing, e.g., a clock drive method. FIG. 19 shows a conventional example of such a horizontal driving circuit based on the clock drive method. In the structure of FIG. 19, the horizontal driving circuit 100 includes a shift register 101, a clock extracting switch group 102, and a sampling switch group 103.

The shift register 101 is composed of n shift stages (transfer stages) and, in response to an input horizontal start pulse HST, performs a shift operation synchronously with horizontal clock signals HCK and HCKX of mutually opposite phases. Consequently, from the respective shift stages of the shift register 101, there are sequentially outputted shift pulses Vs1 to Vsn of which pulse widths are equal to the respective periods of the horizontal clock signals HCK and HCKX, as shown in a timing chart of FIG. 20. These shift pulses Vs1 to Vsn are supplied respectively to switches 102-1 to **102-*n* of the clock extracting switch group 102**.

The switches 102-1 to **102-*n* of the clock extracting switch group 102 are connected, each at one end thereof, alternately to clock lines 104-1 and 104-2, which input the horizontal clock signals HCKX and HCK respectively. In response to shift pulses Vs1 to Vsn delivered from the respective shift stages of the shift register 101, the switches 102-1 to 102-*n* are turned on sequentially to thereby extract the horizontal clock signals HCKX and HCK in sequence. The clock pulses thus extracted are supplied as sampling pulses Vh1 to Vhn to switches 103-1 to 103-*n* of the sampling switch group 103** respectively.

The switches 103-1 to **103-*n* of the sampling switch group 103 are connected, each at one end thereof, to a video line 105 for transmission of a video signal Video therethrough. In response to the sampling pulses Vh1 to Vhn extracted and delivered sequentially via the switches 102-1 to 102-*n* of the clock extracting switch group 102, the switches 103-1 to 103-*n* are turned on sequentially to thereby sample the video signal Video and then supplies the sampled signal to signal lines 106-1 to 106-*n*** of a pixel array (not shown).

In the horizontal driving circuit 100 of the clock drive system in the conventional example mentioned above, the pulses are somewhat delayed due to the wiring resistance, parasitic capacitance, and so forth in the process of transmission from extraction of the horizontal clock signals HCKX and HCK via the switches 102-1 to **102-*n* of the clock extracting switch group 102 to delivery of such extracted signals as sampling pulses Vh1 to Vhn to the respective switches 103-1 to 103-*n* of the sampling switch group 103**.

Such delay of the pulses caused in the process of transmission rounds the waveforms of the sampling pulses Vh1 to Vhn. Consequently, with regard to the second-stage sampling pulse Vh2 for example, there occurs a waveform overlap, as obvious particularly from a timing chart of FIG. 21, between the second-stage sampling pulse Vh2 and each of the preceding first-stage sampling pulse Vh1 and the following third-stage sampling pulse Vh3.

Generally, at the moment when each of the switches 103-1 to **103-*n* of the sampling switch group 103 is turned on, a charge/discharge noise is superposed on the video line 105, as shown in FIG. 21, due to the relationship of the potential to the signal lines 106-1 to 106-*n***.

Under such circumstances, if there exists an overlap between the sampling pulse Vh2 and the pulse of the preceding or following stage as described, the charge/discharge noise derived from turn-on of the third-stage sampling switch 103-3 is sampled at the second-stage sampling timing based on the sampling pulse Vh2. The sampling switches 103-1 to **103-*n* sample and hold the potential of the video line 105 at the timing when the sampling pulses Vh1** to Vhn are turned to an "L" level.

At this time, the charge-discharge noises superposed on the video line 105 are varied, and the timings of turning the sampling pulses Vh1 to Vhn to an "L" level are also varied, so that the sample potentials obtained through the sampling switches 103-1 to **103-*n*** are consequently varied. As a result, such variations of the sample potentials appear to be vertical streaks on the display screen to eventually deteriorate the image quality.

Meanwhile in an active matrix type liquid crystal display device of the dot sequential driving system, as the number of horizontal pixels in particular increases with advance of attaining a higher definition, it becomes difficult to ensure a sufficient sampling time to sequentially sample, in regard to the entire pixels, the input video signal Video of one route within a limited horizontal effective interval. Therefore, in order to ensure a sufficient sampling time, there is adopted a method whereby, as shown in FIG. 22, the video signal is inputted in parallel through m routes (where m is an integer greater than two), while m sampling switches are provided for m horizontal pixels as a unit, and the m pixels as a unit are written sequentially by driving the m sampling switches simultaneously in response to one sampling pulse.

There is considered now one case of displaying a thin black line of a width less than the number m of unit pixels. When such a black line is to be displayed, the video signal Video is inputted with a waveform of FIG. 23(A) wherein the black level portion thereof is shaped like a pulse, and the pulse width thereof is equal to the pulse width of the sampling pulse (B). It is ideal that this pulse-shaped video signal Video has a rectangular waveform, but due to the wiring resistance, parasitic capacitance, and so forth in the video line for transmission of the video signal Video, the leading and trailing edges of the pulse waveform are somewhat rounded (video signal Video') as shown in FIG. 23(C).

If the pulse-shaped video signal Video' having such rounded leading and trailing edges is sampled and held in response to the sampling pulses Vh1 to Vhn, there arises an error that, regarding the pulse-shaped video signal Video', which is essentially to be sampled and held by the kth-stage sampling pulse Vhk, the leading edge thereof is actually sampled and held by the preceding-stage sampling pulse Vhk−1, or the trailing edge of the video signal Video' is sampled and held by the follow-stage sampling pulse Vhk+1. As a result, a ghost is generated. Here, a ghost signifies an undesired disturbing image caused in duplicate with a deviation from the normal image.

The phase relationship of the video signal Video' (hereinafter referred to simply as video signal Video) to the sampling pulse Vhk can be changed in six steps of, e.g., S/H=0 to 5, as shown in FIG. 24, by adjusting the sample-and-hold position on the time base of the video signal Video in a circuit, which processes the video signal Video.

Now a description will be given on the ghost occurrence dependency relative to the sample-and-hold operation. First, there is considered a state where S/H=1. FIG. 25 shows the phase relationship between the video signal Video and the sampling pulses Vhk−1, Vhk, and Vhk+1 when S/H=1 and also shows the potential changes on the signal line. When S/H=1, the pulse-shaped video signal Video is sampled and held by the sampling pulse Vhk, so that a black signal is written in the signal line of the kth stage and a black line is displayed.

However, simultaneously therewith, the black signal is written also in the signal line of the k−1th stage since the black signal portion (pulse portion) of the video signal Video overlaps with the sampling pulse Vhk−1 of the k−1th stage. Consequently, as shown in FIG. 26, a fore ghost is caused at a position of the k−1th stage, i.e., anterior in the horizontal scanning direction. Similarly, when S/H=0, the black signal portion of the video signal Video overlaps with the sampling pulse Vhk−1 of the k−1th stage, so that a fore ghost is caused at an anterior position in the horizontal scanning direction.

Next, there is considered another state where S/H=5. FIG. 27 shows the phase relationship between the video signal Video and the sampling pulses Vhk−1, Vhk, and Vhk+1 when S/H=5 and also shows the potential changes on the signal line. In the case of S/H=5, the video black signal overlaps with the sampling pulse Vhk+1 of the k+1th stage. The black signal is written in the signal line of the k+1th stage when the sampling switch is turned on, and then the potential level is lowered to return to the gray level. However, since the amount of overlap is great, the signal line potential fails to return completely down to the gray level. Therefore, as shown in FIG. 28, a back ghost is caused at a position of the k+1th stage, i.e., posterior in the horizontal scanning direction.

In any other case of S/H=1 to 4, as in the above-described case of S/H=5, the video black signal overlaps with the sampling pulse Vhk+1 of the k+1th stage, and the black signal is written in the signal line when the sampling switch is turned on. However, since the amount of overlap is smaller and the written black level is lower in comparison with the above case of S/H=5, the signal line potential returns completely down to the gray level. Consequently, no ghost is caused.

In the process mentioned, a ghost is derived from the overlap between the video signal Video and the sampling pulse. Here, the number of sample-and-hold positions, where no ghost is caused at any of anterior and posterior positions as in S/H=2, 3, 4, is defined as a margin to a ghost (hereinafter referred to as ghost margin).

Thus, it is impossible to eliminate the problem that the waveform of the pulse-shaped video signal Video are rounded at its leading and trailing edges due to the wiring resistance, parasitic capacitance, and so forth existing in the video line, but occurrence of a ghost can be avoided by properly setting an optimal sample-and-hold position in the circuit, which processes the video signal Video.

However, since the waveform of the pulse-shaped video signal Video is rounded at its leading and trailing edges by the wiring resistance, parasitic capacitance and so forth in the video line, the pulse waveform portion of the video signal Video is distorted to overlap with the sampling pulse in the preceding or following stage, so that it is rendered impossible to attain a large ghost margin correspondingly thereto. In the example mentioned above, the ghost margin is limited to three, i.e., S/H=2, 3, 4.

Next, a description will be given on a conventional active matrix type display device based on a dot sequential driving system where a clock drive method is applied to its horizontal driving circuit of a divided sample-and-hold system. The conventional active matrix type display device is composed of a panel having gate lines in rows, signal lines in columns, and pixels arrayed to form a matrix in the intersections of such rows and columns. Each of the pixels includes, e.g., a thin film transistor (TFT) as an active element. There are further provided a vertical driving circuit and a horizontal driving circuit. The vertical driving circuit is connected to each of the gate lines and selects the row of the pixels sequentially. The horizontal driving circuit is connected to each of the signal lines and writes the video signal in the pixels of the selected row. In the dot sequential driving system, the video signal is written dot-sequentially in the pixels of the selected row.

In the active matrix type display device, there exists a parasitic capacitance between a source/drain electrode of the TFT and each of the signal lines. Some image fault including vertical streaks and so forth may occur when a potential variation derived from such parasitic capacitance at the time of writing the video signal via one signal line has plunged into the adjacent signal line. This vertical streak fault becomes conspicuous particularly when a checkered pattern is displayed by a line inverse driving system. Alternatively, a vertical streak is liable to occur when a horizontal line having a thickness of one dot (one pixel) is displayed by the line inverse driving system.

In order to prevent such plunge of a video signal between signal lines, there is proposed a divided sample-and-hold driving method, which is disclosed in Japanese Patent Laid-open No. 2000-267616 for example. According to this divided sample-and-hold method, an input video signal is separated into two routes, and at the time of writing the video signal by the dot sequential system, the signals of the two routes are written while being overlapped with each other in mutually adjacent pixels.

FIG. 29 typically shows an example of a display device adopting the above divided sample-and-hold driving method. As shown in the diagram, the display device is composed of a panel having gate lines 113 in rows, signal lines 112 in columns, pixels 111 arrayed to form a matrix in the intersections of such rows and columns, and two video lines 125 and 126 for supplying video signals Video 1 and Video 2 separated into two routes in a predetermined phase relationship. Further, a sampling switch group 123 is disposed correspondingly to each signal line 112, and two signal lines are connected as a unit between the two video lines respectively. More specifically, the first signal line is connected to one video line 125 via the sampling switch, and the second signal line is connected to the other signal line 126 via the sampling switch. Thereafter, the third and subsequent signal lines are also connected alternately to the two video lines 125 and 126 via the sampling switches. The panel further includes a vertical driving circuit 116 and a horizontal driving circuit 117 provided therein. The vertical driving circuit 116 is connected to each gate line 113 and selects the rows of the pixels 111 sequentially. In other words, the pixels 111 arrayed to form a matrix are selected row by row sequentially. The horizontal driving circuit 117 operates in accordance with a clock signal of a predetermined period and sequentially generates sampling pulses A, B, C, D, . . . , which are not overlapped with respect to the switches of the sampling switch group 123 connected to the same video line but are overlapped with respect to the adjacent switches, hence turning on or off the switches in sequence to thereby write the video signal dot-sequentially in the pixels 111 of the selected row. The display device further has a clock generating circuit 189 to supply a clock signal HCK, which serves as an a reference to the operation of the horizontal driving circuit 117, and also supplies a start pulse HST. The horizontal driving circuit 117 is composed of shift registers (S/R) 121 connected in a multiplicity of stages and transfers HST in response to HCK sequentially to thereby generate the above-described sampling pulses A, B, C, D, and so forth.

Referring now to a waveform chart of FIG. 30, a brief explanation will be given on the operation of the conventional display device shown in FIG. 29. As described, the horizontal driving circuit operates in accordance with a clock signal HCK and transfers a start pulse HST sequentially to thereby generate sampling pulses A, B, C, D, and so forth. As obvious from this waveform chart, the sampling pulses overlap with each other between the mutually adjacent signal lines. That is, the sampling pulse A corresponding to the first signal line overlaps with the sampling pulse B corresponding to the second signal line. Similarly, the sampling pulse B corresponding to the second signal line overlaps with the sampling pulse C corresponding to the third signal line. Since the video signal is supplied from separate video lines to the mutually adjacent signal lines, no problem arises from such overlap. Sampling pulses are generated in such a manner as to overlap with respect to the sampling switches of the mutually adjacent signal lines, so that it becomes possible to prevent the vertical streak fault that has been known heretofore. More specifically, a parasitic capacitance is existent between the source/drain electrode of each pixel transistor and each of the signal lines, and if a potential variation on one signal line plunges into the adjacent signal line via such parasitic capacitance, no harmful effect is exerted by such plunge of the video signal as the relevant signal line is kept at a low impedance due to the overlap sampling.

In the shown example, a signal potential Sig1 is sampled and held, in response to the sampling pulse A, on the corresponding first signal line. Subsequently, a signal potential Sig2 is sampled and held, in response to the sampling pulse B, on the second signal line. At this time, a potential change is produced on the second signal line. Although this potential change plunges also into the first signal line because of the parasitic capacitance, the first signal line is kept at a low impedance since the corresponding sampling switch is still open at this time, so that no harmful effect is exerted despite such plunge of the signal.

FIG. 31 typically represents the video signal sampling timing to each signal line and the potential change produced on each video line. Fundamentally, each sampling pulse is so generated as not to overlap with respect to the sampling switches connected to the same video line. For example, the first signal line and the third signal line are connected to the same video line. Therefore, the circuit is so designed that, in principle, the sampling pulse A and the sampling pulse C do not overlap with each other. Actually, however, some delay is derived from the wiring resistance, parasitic capacitance, and so forth in the process of transmitting the pulses, hence rounding the waveform. As a result, a partial overlap is caused between the sampling pulse A and the sampling pulse C. When the sampling pulse C rises in such a state, the corresponding sampling switch is opened and a charge/discharge is generated to the signal line, whereby a potential fluctuation is produced in the video signal Video1 on the video line, as indicated by a solid-line arrow. At this moment, since the preceding sampling pulse A has not yet fallen completely, the potential fluctuation (charge/discharge noise) on the video line is picked up, as indicated by a dotted-line arrow. Consequently, a potential variation sampled on the signal line is caused to appear as a vertical streak on the screen, hence deteriorating the image quality eventually. Furthermore, because of such interference of the video signal between the signal lines connected to the same video line, there may occur a ghost or the like on the screen.

DISCLOSURE OF INVENTION

The present invention has been accomplished in view of the problems mentioned above. It is a first object of the invention to provide a display device, which is capable of realizing complete non-overlap sampling in execution of horizontal driving by a clock drive system so as to suppress occurrence of vertical streaks derived from overlap sampling, and further capable of setting a great ghost margin.

A second object of the present invention resides in providing improvements in an active matrix type display device where a divided sample-and-hold method is adopted. The display device is capable of eliminating interference of a video signal caused between signal lines connected to the same video line, thereby suppressing any image fault inclusive of vertical streaks, ghosts, and the like.

In order to achieve the first object of the present invention mentioned above, the following means have been contrived. The display device of the invention includes a panel having gate lines in rows, signal lines in columns, and pixels arrayed to form a matrix in the intersections of such rows and columns; a vertical driving circuit connected to the gate lines and selecting the row of the pixels sequentially; a horizontal driving circuit connected to the signal lines and, in response to a clock signal of a predetermined period, writing a video signal sequentially in the pixels of the selected row; and a clock generating means for generating a first clock signal used as a reference to the operation of the horizontal driving circuit, and also generating a second clock signal equal in period to but smaller in duty ratio than the first clock signal. The horizontal driving circuit has a shift register for outputting shift pulses sequentially from respective shift stages thereof by performing a shift operation synchronously with the first clock signal; a first switch group for extracting the second clock signal in response to the shift pulses outputted sequentially from the shift register; and a second switch group for sampling the input video signal sequentially in response to the second clock signal extracted by the switches of the first switch group, and supplying the sampled signal to each signal line. The clock generating means is divided into an external clock generating circuit disposed outside the panel and supplying the second clock signal externally, and an internal clock generating circuit formed within the panel and supplying the first clock signal to the horizontal driving circuit in accordance with the second clock signal.

More specifically, the internal clock generating circuit includes a D type flip-flop for generating the first clock signal by processing the second clock signal supplied thereto from the external clock generating circuit. In this case, the D type flip-flop is composed of a plurality of NAND elements. On the other hand, the external clock generating circuit is capable of variably adjusting the duty ratio of the second clock signal.

In the above structure, each switch of the first switch group sequentially extracts the second clock signal in response to the shift pulses outputted in sequence from the shift register synchronously with the first clock signal. As a result, the second clock signal being smaller in duty ratio than the first clock signal is supplied as a sampling signal to the second switch group. Then each switch of the second switch group sequentially samples and holds the input video signal in response to the sampling signal and supplies the video signal to the signal lines of the pixels. At this time, since the duty ratio of the sampling signal is smaller than that of the first clock signal, it becomes possible to realize complete non-overlap sampling.

Particularly in the present invention, the clock generating means is divided into an external clock generating circuit and an internal clock generating circuit. The external clock generating circuit supplies the second clock signal, while the internal clock generating circuit generates the first clock signal, whereby the number of clock signals inputted externally to the panel can be reduced. Consequently, it is rendered possible to simplify the terminals, wiring, and so forth formed in the panel for external connection. The external clock generating circuit is capable of variably adjusting the pulse width of the second clock signals. Meanwhile, the internal clock generating circuit generates the first clock signal having a fixed pulse width. For the purpose of suppressing occurrence of vertical streaks and setting a large ghost margin by complete non-overlap sampling, it is necessary to set the pulse width of the second clock signal to an optimal value. In this case, the configuration of the external clock generating circuit can be designed relatively freely, so that the circuit is preferable for generating a clock signal of a variable pulse width. On the other hand, the first clock signal used for operating the horizontal driving circuit may be fixed in its pulse width. Therefore, the configuration of the internal clock generating circuit to generate the first clock signal may be relatively simple, and accordingly it can be incorporated preferably in the panel.

In order to achieve the second object of the present invention, the following means have been contrived. The display device of the invention includes a panel having gate lines in rows, signal lines in columns, pixels arrayed to form a matrix in the intersections of such rows and columns, and n video lines for supplying video signals separated into n routes (where n is an integer greater than two) in a predetermined phase relationship; a vertical driving circuit connected to the gate lines and selecting the row of the pixels sequentially; a sampling switch group disposed correspondingly to each signal line and connected between the n video lines in units of n signal lines; a horizontal driving circuit operating in accordance with a clock signal of a predetermined period, and sequentially generating sampling pulses, which are not overlapped with respect to the switches of the sampling switch group connected to the same video line but are overlapped with respect to the adjacent switches, and driving the switches sequentially to thereby write the video signal sequentially in the pixels of the selected row; and a clock generating means for generating a first clock signal used as a reference to the operation of the horizontal driving circuit, and also generating a second clock signal longer in pulse width than the first clock signal. The horizontal driving circuit has a shift register for outputting shift pulses sequentially from respective shift stages thereof by performing a shift operation synchronously with the first clock signal; and an extracting switch group for sequentially generating the sampling pulses by extracting the second clock signal in response to the shift pulses outputted sequentially from the shift register.

Preferably, the clock generating means is divided into an external clock generating circuit disposed outside the panel and supplying the first clock signal externally to the horizontal driving circuit, and an internal clock generating circuit formed within the panel and supplying the second clock signal internally to the horizontal driving circuit. In this case, the internal clock generating circuit generates the second clock signal by processing the first clock signal supplied from the external clock generating circuit. Concretely, the internal clock generating circuit includes a delay circuit for delaying the first clock signal, and generates the second clock signal out of the first clock signal prior to the delay process and the first clock signal posterior to the delay process. In this case, the delay circuit is composed of an even number of inverters connected in series. The internal clock generating circuit has a NOR circuit for generating the second clock signal by NOR-combining the first clock signal prior to the delay process with the first clock signal posterior to the delay process.

According to the above structure that represents the display device adopting a divided sample-and-hold driving method, shift pulses outputted from a horizontal driving circuit are extracted in response to the other clock signal, and sampling pulses are generated. Due to introduction of such a clock drive method, complete non-overlap of the sampling pulses can be realized between the signal lines connected alternately to the same video line, while overlap is kept in the sampling pulses between the mutually adjacent signal lines.

BEST MODE FOR CARRYING OUT THE INVENTION

Figure 1:
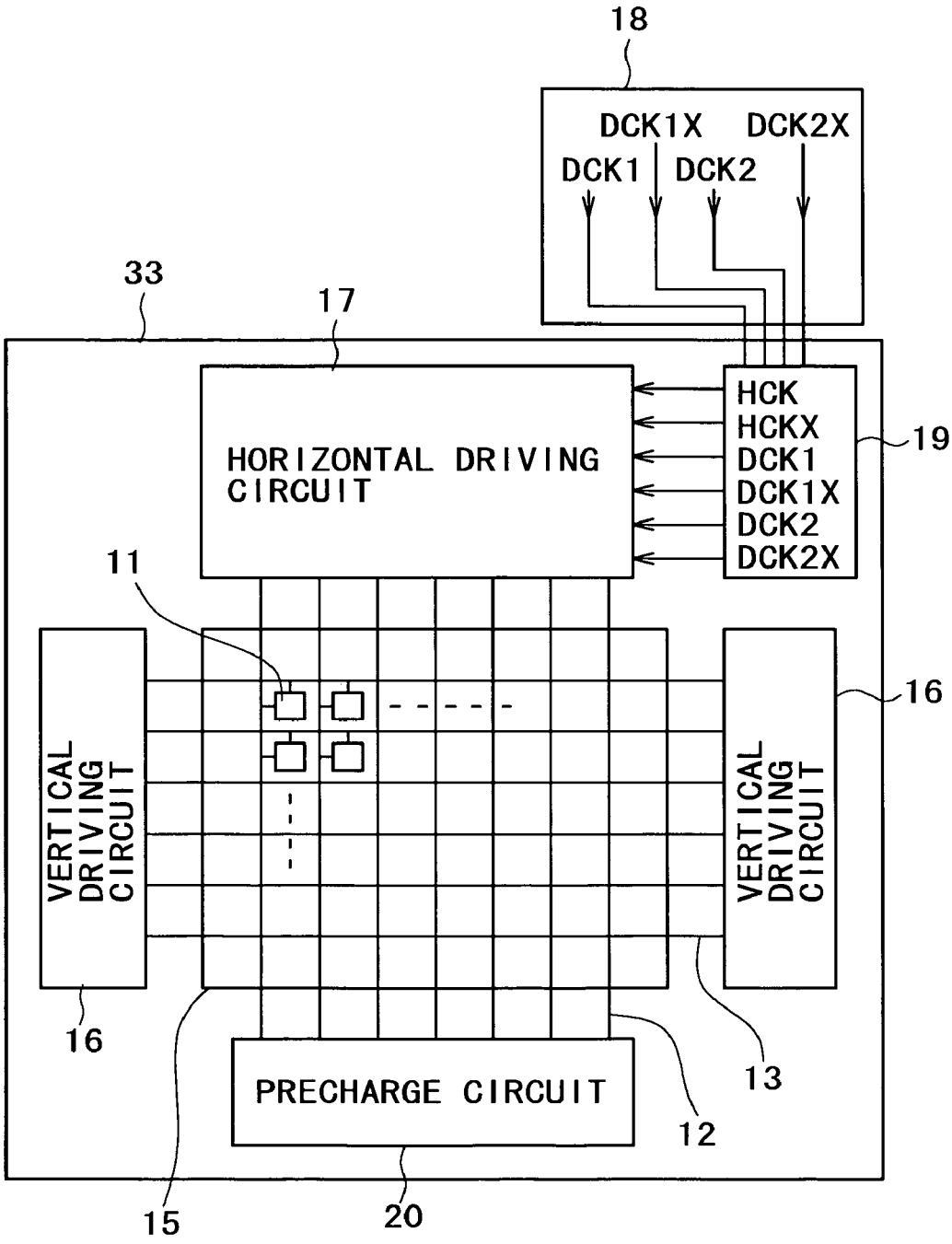
FIG. 1 is a block diagram showing the fundamental structure of a display device related to the first aspect of the present invention.

Hereinafter an embodiment of the present invention will be described in detail with reference to the accompanying drawings. FIG. 1 is a typical block diagram showing the fundamental structure of a display device related to the first aspect of the present invention. As shown, this display device is composed of a panel 33 where a pixel array 15, a vertical driving circuit 16, a horizontal driving circuit 17, and so forth are formed integrally. The pixel array 15 includes gate lines 13 in rows, signal lines 12 in columns, and pixels 11 arrayed to form a matrix in the intersections of such rows and columns. The vertical driving circuit 16 is disposed separately on the left and right and is connected to the two ends of each gate line 13 for selecting the row of the pixels 11 sequentially. The horizontal driving circuit 17 is connected to the signal lines 12 and operates in accordance with a clock signal of a predetermined period in a manner to write a video signal sequentially in the pixels 11 of the selected row. The display device further has a clock generating means, which generates first clock signals HCK and HCKX used as a reference to the operation of the horizontal driving circuit 17, and second clock signals DCK1, DCK1X, DCK2, DCK2X being equal in period to but smaller in duty ratio than the first clock signals HCK and HCKX. HCKX is an inverted signal of HCK. Similarly, DCK1X is an inverted signal of DCK1, and DCK2X is an inverted signal of DCK2. A precharge circuit 20 is connected to each signal line 12 and executes precharge prior to writing the video signal so as to improve the image quality.

A characteristic item of the present invention resides in that the horizontal driving circuit 17 has a shift register, a first switch group and a second switch group. The shift register performs a shift operation synchronously with the first clock signals HCK, HCKX and outputs shift pulses sequentially from the respective shift stages thereof. The first switch group extracts the second clock signals DCK1, DCK1X, DCK2, DCK2X in response to the shift pulses outputted sequentially from the shift registers. The second switch group sequentially samples the video signal, which is inputted externally, in response to the second clock signals DCK1, DCK1X, DCK2, DCK2X and then supplies the sampled signal to the signal lines 12. Due to such a structure, complete non-overlap sampling can be realized.

Another characteristic item of the present invention resides in that the aforementioned clock generating means is divided into an external clock generating circuit 18 and an internal clock generating circuit 19. The external clock generating circuit 18 is provided on a driving system board (not shown) disposed outside the panel 33 and supplies the second clock signals DCK1, DCK1X, DCK2, DCK2X externally to the panel 33. Meanwhile the internal clock generating circuit 19 is formed in the panel 33 together with the vertical driving circuit 16 and the horizontal driving circuit 17 and generates the first clock signals HCK and HCKX by processing the second clock signals DCK1, DCK1X, DCK2, DCK2X supplied from the external clock generating circuit 18. The first clock signals HCK and HCKX generated internally are sent to the horizontal driving circuit 17 together with the second clock signals DCK1, DCK1X, DCK2, and DCK2X. The external clock generating circuit 18 is capable of variably adjusting the duty ratios of the second clock signals DCK1, DCK1X, DCK2, DCK2X. In contrast therewith, the internal clock generating circuit 19 generates the first clock signals HCK and HCKX where the duty ratios are fixed.

Figure 2:
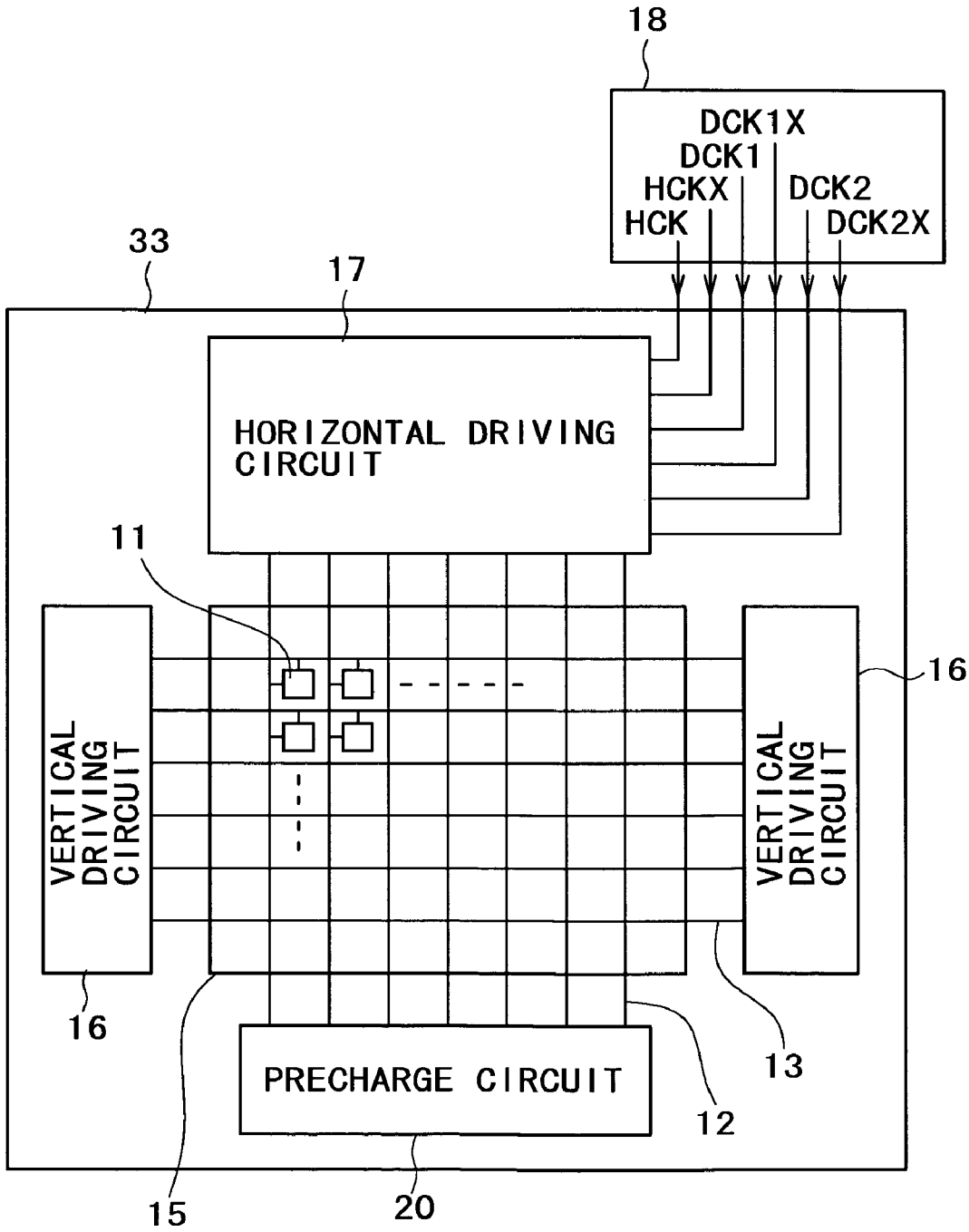
FIG. 2 is a typical block diagram showing a reference example of a display device.

FIG. 2 is a typical block diagram showing a reference example of a display device. In order to compare this example with the display device of the present invention, any component parts corresponding to those in FIG. 1 are denoted by like reference numerals. The point different from the display device of the invention shown in FIG. 1 is that the first clock signals HCK, HCKX and the second clock signals DCK1, DCK1X, DCK2, DCK2X are supplied entirely from the external clock generating circuit 18, and any internal clock generating circuit is not incorporated in the panel 33. In the reference example of FIG. 2, at least six terminals and the wirings related thereto are necessary for connecting the external clock generating circuit 18 to the panel 33. In contrast therewith, the display device of the present invention shown in FIG. 1 requires merely four terminals for external connection.

Figure 3:
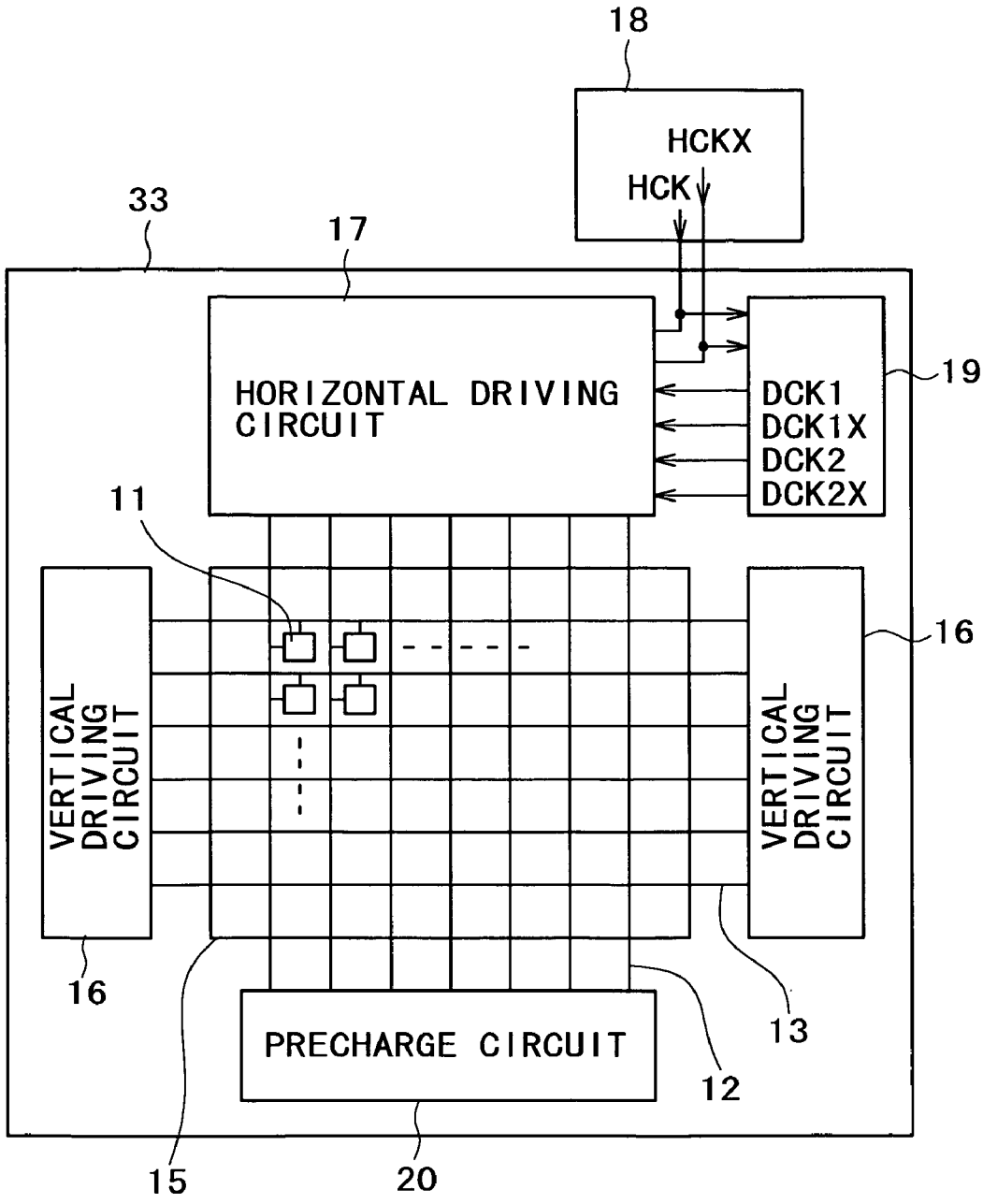
FIG. 3 is a typical block diagram showing another reference example of a display device.

FIG. 3 is a typical block diagram showing another reference example of a display device. In order to compare this example with the display device of the present invention, any component parts corresponding to those in FIG. 1 are denoted by like reference numerals. The point different from the display device of the invention shown in FIG. 1 is that the first clock signals HCK and HCKX are supplied externally from the external clock generating circuit 18, while the second clock signals DCK1, DCK1X, DCK2, DCK2X are generated internally by the internal clock generating circuit 19. The internal clock generating circuit 19 logically processes the first clock signals HCK and HCKX supplied thereto from the external clock generating circuit 18 and forms the second clock signals DCK1, DCK1X, DCK2, DCK2X. The internal clock generating circuit 19 has a relatively simple logic circuit configuration, wherein inverters of a predetermined number of stages are employed for setting the pulse width of the second clock signal DCK. That is, the first clock signal HCK is delayed via the series-connected inverters to thereby set the pulse width of the second clock signal DCK. Since the pulse width of the second clock signal is determined by the number of stages of the connected inverters, the pulse width is basically fixed and cannot be variably adjusted. However, in the reference example of FIG. 3, only two terminals for external connection are needed with regard to the first clock signals HCK and HCKX.

In the reference example of FIG. 2, the second clock signal (hereinafter referred to as DCK pulse in some case) is produced in a system board outside the panel, so that it is possible to freely adjust the phase and the pulse width of the DCK pulse in relation to the first clock signal (hereinafter referred to as HCK pulse in some case). However, besides the first clock signals HCK and HCKX, four routes of input signals need to be added, i.e., the second clock signals DCK1, DCK1X, DCK2 and DCK2X, whereby four pad terminals are increased for external connection. Such a numerical increase of the pad terminals is not desirable since it brings about difficulty in reducing the panel size. Also in the reference example of FIG. 3, DCK pulses are produced in the panel on the basis of the HCK pulses supplied from the external clock generating circuit 18, so that the number of the pad terminals is not increased. However, as the DCK pulse width is determined by the number of the inverters in the internal clock generating circuit 19, it is impossible to attain free adjustment of the DCK pulse width. Since an optimal DCK pulse width needs to be obtained with regard to a vertical streak or ghost margin, its variability is necessary. On the other hand, any increase of the number of pad terminals needs to be minimized. In view of such requirements, the display device of the present invention shown in FIG. 1 is so contrived as to minimize the increase of the number of pad terminals to two, i.e., from the known two terminals for HCK and HCKX to four terminals for DCK1, DCK1X, DCK2 and DCK2X. Further, as the second clock signals are supplied from the external clock generating circuit 18, it becomes possible to optimally adjust the DCK pulse width.

Figure 4:
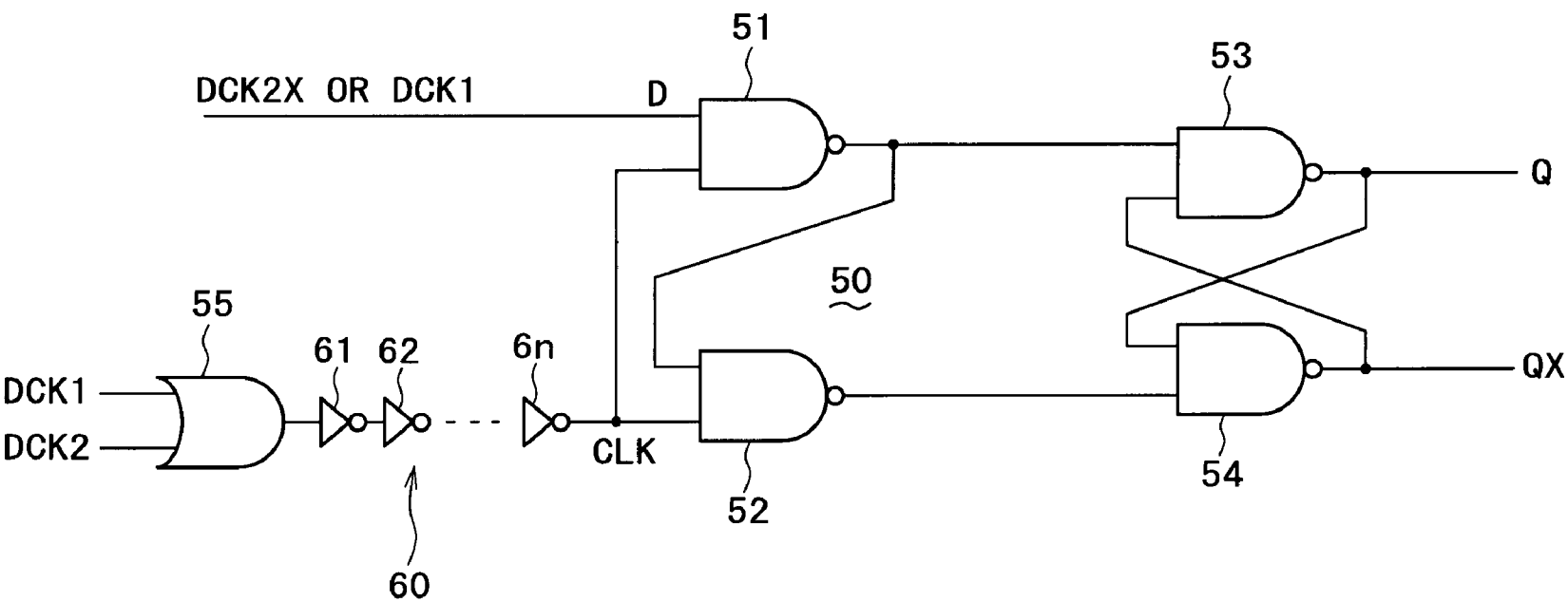
FIG. 4 is a block diagram showing a concrete structural example of an internal clock generating circuit incorporated in the display device of FIG. 1.

FIG. 4 is a block diagram showing a concrete structure of the internal clock generating circuit 19 shown in FIG. 1. This internal clock generating circuit is formed at the upper right of the panel and produces. HCK pulses out of the DCK pulses. As shown in the diagram, the internal clock generating circuit fundamentally is composed of a D type flip-flop. Particularly in this example, the D type flip-flop 50 includes four NAND elements 51–54. The D type flip-flop 50 has an input terminal D, a clock terminal CLK, and a pair of output terminals Q and QX. The D type flip-flop catches an input signal D by the leading edge of a clock pulse CLK and produces its output signal Q. The other output signal QX is an inversion of one output signal Q. In this example, out of the second clock signals supplied from the external clock generating circuit, either DCK2X or DCK1 is used as the input signal. Also out of the second clock signals supplied from the external clock generating circuit, there is used a pulse waveform as a clock pulse CLK obtained by OR-processing DCK1 and DCK2 through an OR element 55 and then delaying its output in a delay circuit 60. The delay circuit 60 is composed of inverters 61, 62, . . . 6*n* connected in series.

Figure 5:
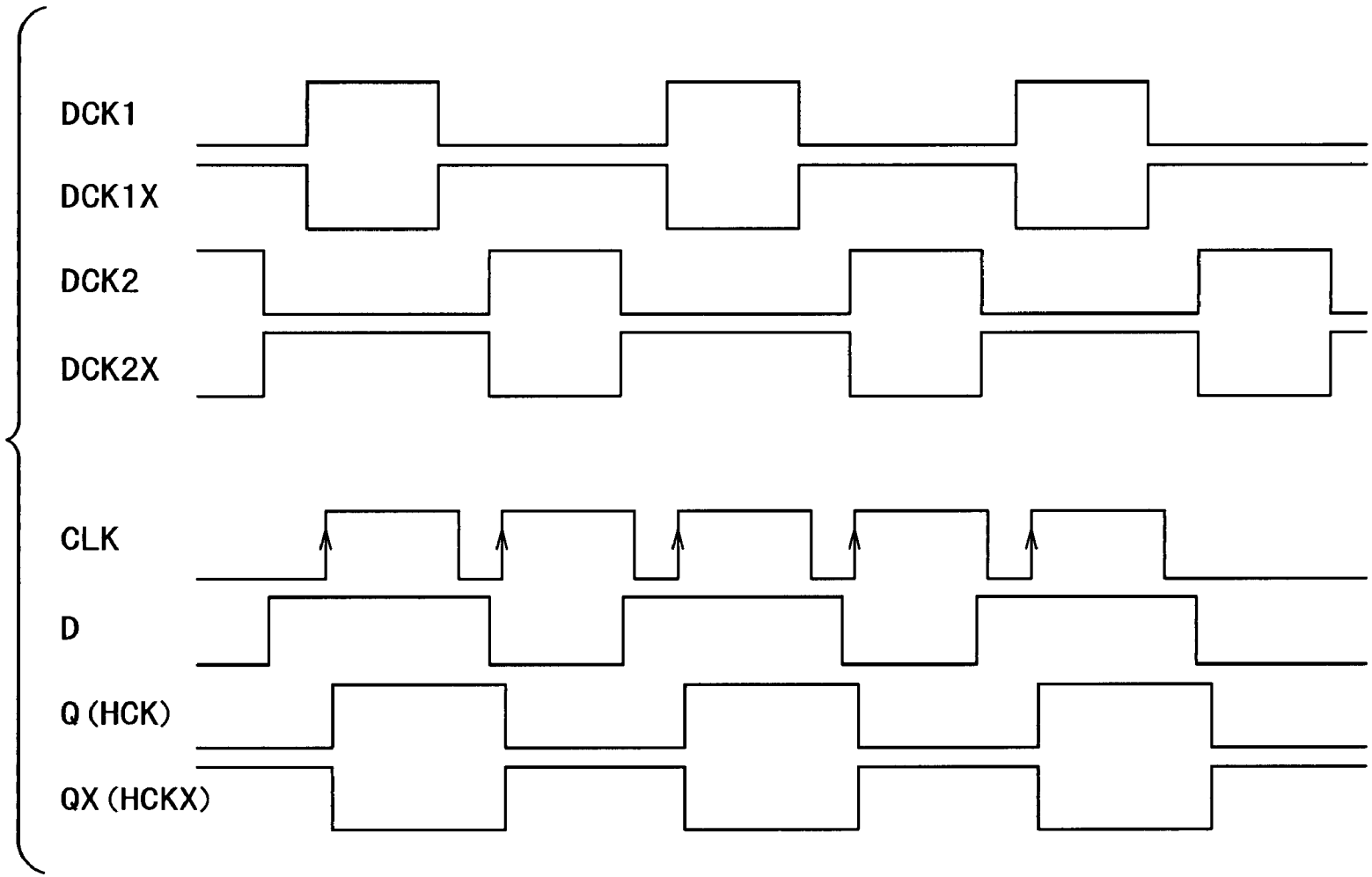
FIG. 5 is a timing chart for explaining the operation of the internal clock generating circuit shown in FIG. 4.

FIG. 5 is a waveform chart for explaining the operation of the internal clock generating circuit shown in FIG. 4. The second clock signals DCK1 and DCK1X supplied externally have a predetermined pulse width and are mutually opposite in polarity. Similarly, DCK2 and DCK2X have a predetermined pulse width and are mutually opposite in polarity. DCK1 and DCK2 have a phase deviation of 180° C. from each other. In this embodiment, clock pulses CLK are obtained by OR-processing DCK1 and DCK2. Since DCK1 and DCK2 have a phase deviation of 180° C. from each other, the interval between the leading edges of the clock pulses CLK is coincident with a ½ period of desired HCK pulses. The HCK pulses have a duty ratio of 50%, while the DCK pulses are equal in period to the HCK pulses and have a smaller duty ratio. In this embodiment, DCK2X is used as an input signal D. Here, in order to avoid that the leading edge of the input pulse D and the leading edge of the clock pulse CLK overlap with each other, CLK is delayed previously in the delay circuit 60 and then is inputted to the D type flip-flop 50. As mentioned, the D type flip-flop catches the input signal D by the leading edge of the clock pulse CLK and then sends the same to the output terminal Q. Therefore, the output signal Q is equal in period to the DCK pulse and has a duty ratio of 50% so as to be usable as an HCK pulse. At the output terminal QX, there is obtained HCKX, which is an inversion of the HCK pulse. The HCK pulse thus obtained is used for the operation of the horizontal driving circuit. The DCK pulses are supplied from an external clock generating circuit provided on a driving system board. The DCK pulse width is variable on the system board side. Thus, in the display device of the present invention, the DCK pulse width can be varied, and the number of the input signals supplied to the panel can be reduced to four.

Figure 6:
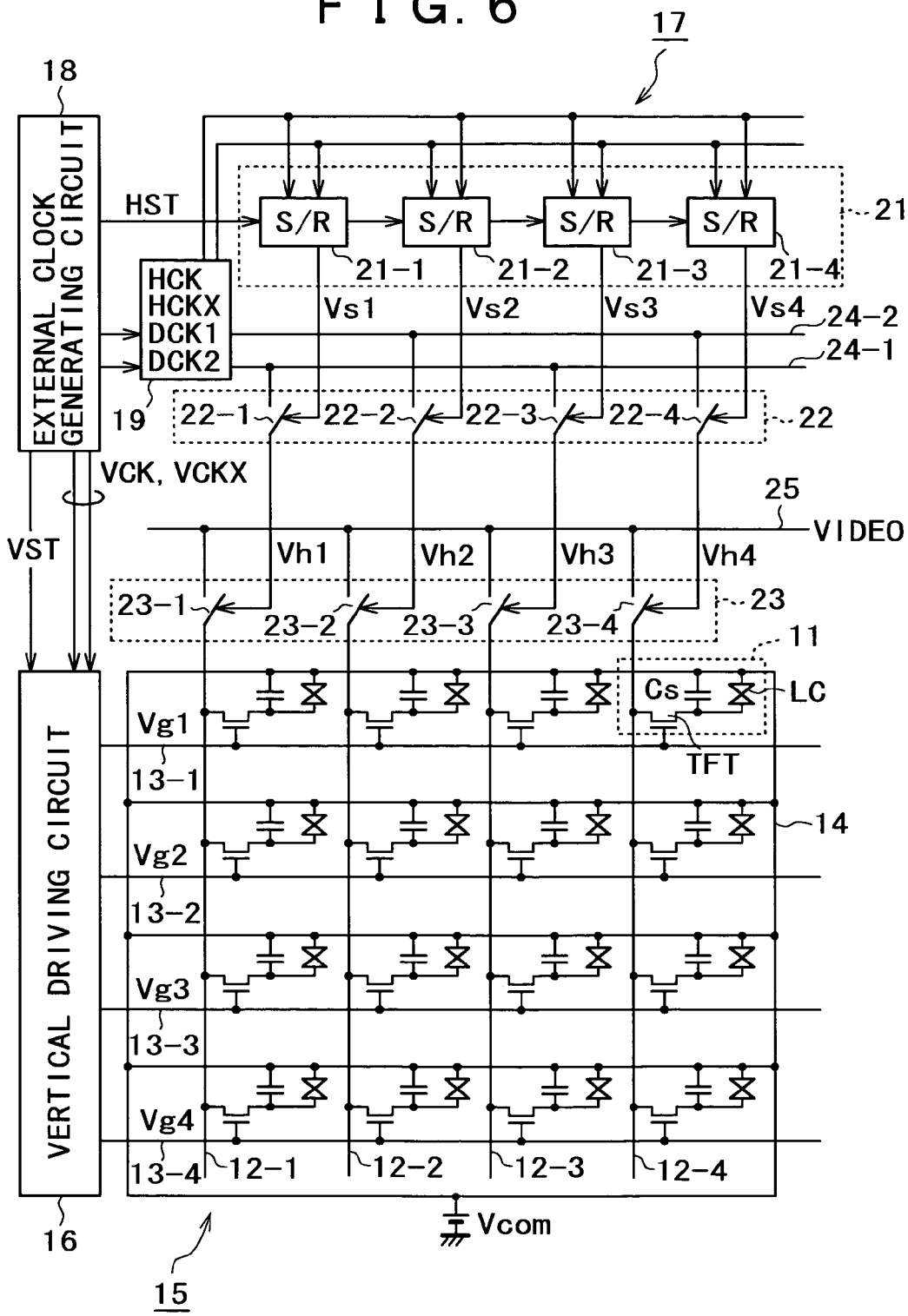
FIG. 6 is a circuit diagram showing a structural example of an active matrix type liquid crystal display device based on a dot sequential driving system according to an embodiment of the present invention.

FIG. 6 is a circuit diagram showing a structural example of an active matrix type liquid crystal display device based on a dot sequential driving system according to an embodiment of the present invention where liquid crystal cells for example are used as display elements (electro-optical elements) of pixels. For the purpose of simplifying the diagram, there is shown here an exemplary case of a pixel array with four rows and four columns. In an active matrix type liquid crystal display device, it is usual that a thin film transistor (TFT) is used as a switching element of each pixel.

In FIG. 6, each of the four-row four-column pixels 11 arrayed to form a matrix includes a thin film transistor TFT serving as a pixel transistor, a liquid crystal cell LC where a pixel electrode is connected to a drain electrode of the thin film transistor TFT, and a hold capacitance Cs of which one electrode is connected to the drain electrode of the thin film transistor TFT. With respect to such pixels 11, signal lines 12-1 to 12-4 are wired column by column in the pixel array direction, and gate lines 13-1 to 13-4 are wired row by row in the pixel array direction.

In each of the pixels 11, the source electrode (or drain electrode) of the thin film transistor TFT is connected to the corresponding one of the signal lines 12-1 to 12-4. The gate electrode of the thin film transistor TFT is connected to the gate lines 13-1 to 13-4 respectively. The counter electrode of the liquid crystal cell LC and the other electrode of the hold capacitance Cs are connected to a Cs line 14 in common between the pixels. A predetermined DC voltage is applied as a common voltage Vcom to the Cs line 14.

Thus, there is structured a pixel array 15 where the pixels 11 are arrayed to form a matrix, and the signal lines 12-1 to 12-4 are wired column by column with respect to the pixels 11, and further the gate lines 13-1 to 13-4 are wired row by row. In this pixel array 15, one end of each of the gate lines 13-1 to 13-4 is connected to the output end of the corresponding row of a vertical driving circuit 16 disposed, for example, on the left of the pixel array 15.

The vertical driving circuit 16 performs vertical scanning (in the row direction) per field and sequentially selects, row by row, the pixels 11 connected to the gate lines 13-1 to 13-4. More specifically, when a scanning pulse Vg1 is delivered from the vertical driving circuit 16 to the gate line 13-1, the pixels of the respective columns on the first row are selected. When a scanning pulse Vg2 is delivered to the gate line 13-2, the pixels of the respective columns on the second row are selected. Similarly, scanning pulses Vg3 and Vg4 are delivered sequentially to the gate lines 13-3 and 13-4.

A horizontal driving circuit 17 is disposed, for example, above the pixel array 15. And an external clock generating circuit (timing generator) 18 is provided for supplying various clock signals to the vertical driving circuit 16 and the horizontal driving circuit 17. This external clock generating circuit 18 generates a vertical start pulse VST to instruct start of vertical scanning, vertical clock pulses VCK and VCKX having mutually opposite phases and used as a reference to vertical scanning, and a vertical start pulse HST to instruct start of horizontal scanning. In addition, the external clock generating circuit 18 further generates clock pulses DCK1 and DCK2 used to produce sampling pulses therefrom.

Figure 7:
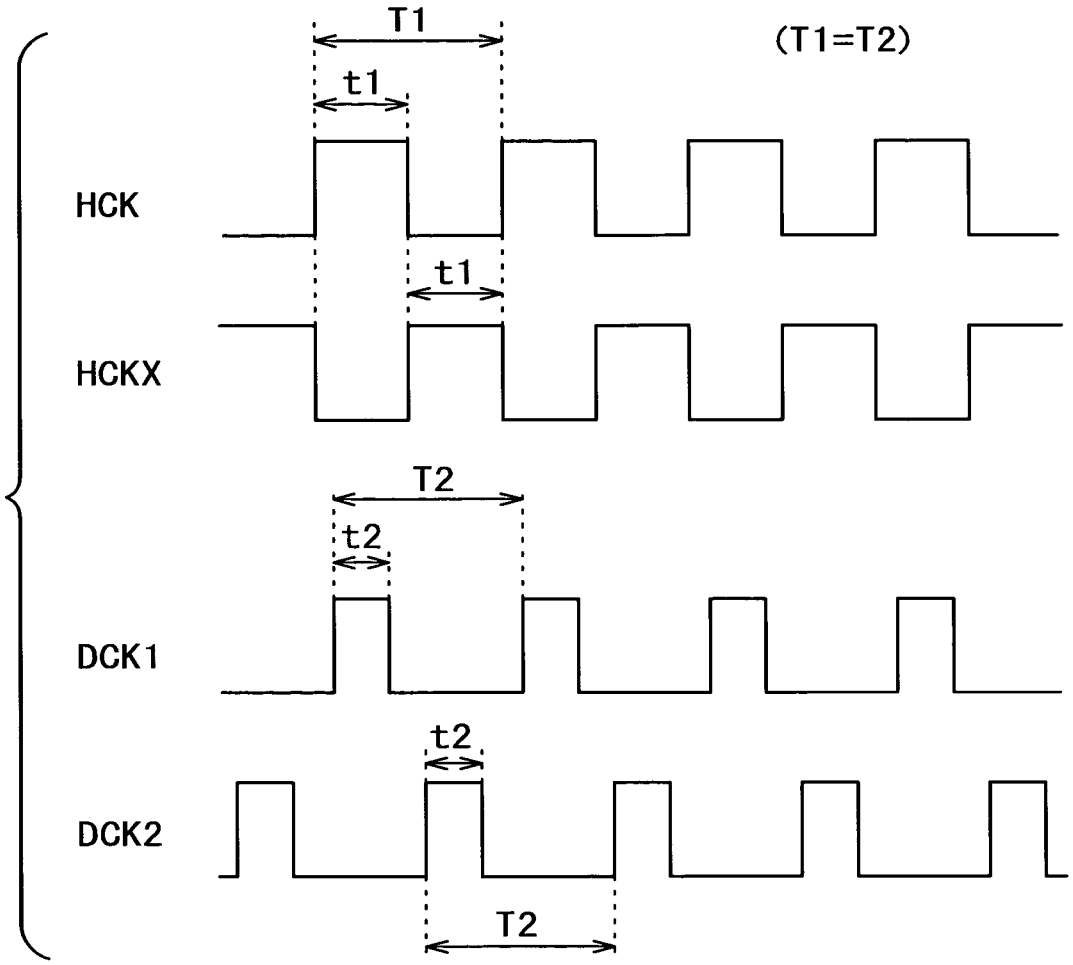
FIG. 7 is a timing chart showing the timing relationship between horizontal clock pulses HCK, HCKX and clock pulses DCK1, DCK2.

An internal clock generating circuit 19 is provided separately from the external clock generating circuit 18. The internal clock generating circuit 19 generates, on the basis of DCK1 and DCK2 supplied from the external clock generating circuit 18, HCK and HCKX having mutually opposite phases and used as a reference to horizontal scanning. As shown in the timing chart of FIG. 7, the horizontal clock pulses HCK and HCKX have a period T1, a pulse width t1, and a duty ratio of 50%. In contrast therewith, the pulses DCK1 and DCK2 have a period T2 and a pulse width t2. Since T1=T2, the pulses HCK and DCK are equal in period to each other. On the other hand, t2 is smaller than t1, and the duty ratio of the pulse DCK is smaller than that of the pulse HCK. Here, the term "duty ratio" is defined as a ratio of the pulse width t to the pulse repetition period T in a pulse waveform.

In this embodiment, the duty ratio (t1/T1) of the horizontal clock pulses. HCK and HCKX is 50%, and the duty ratio (t2/T2) of the clock pulses DCK1 and DCK2 is smaller than 50%, i.e., the pulse width t2 of the clock pulses DCK1 and DCK2 is set to be narrower than the pulse width t1 of the horizontal clock pulses HCK and HCKX.

The horizontal driving circuit 17 sequentially samples the input video signal Video per horizontal scanning interval (1H) and writes the sampled signal in the pixels 11 of the row selected by the vertical driving circuit 16. In this embodiment, the horizontal driving circuit 17 is formed by adopting a clock drive method and includes a shift register 21, a clock extracting switch group 22, and a sampling switch group 23.

The shift register 21 is composed of four shift stages (S/R) 21-1 to 21-4 corresponding to the pixel columns (four columns in this embodiment) of the pixel array 15. In response to a horizontal start pulse HST, the shift register 21 performs a shift operation synchronously with the horizontal clock pulses HCK and HCKX having mutually opposite phases. Consequently, as shown in a timing chart of FIG. 8, shift pulses Vs1 to Vs4 having a pulse width equal to the period of the horizontal clock pulses HCK and HCKX are outputted sequentially from the shift stages 21-1 to 21-4 of the shift register 21.

The clock extracting switch group 22 is composed of four switches 22-1 to 22-4 corresponding to the pixel columns of the pixel array 15, wherein one end of each of such switches 22-1 to 22-4 is connected alternately to clock lines 24-1 and 24-2 through which the clock pulses DCK2 and DCK1 are transmitted from the external clock generating circuit 18 via the internal clock generating circuit 19. That is, one end of each of the switches 22-1 and 22-3 is connected to the clock line 24-1, and one end of each of the switches 22-2 and 22-4 is connected to the clock line 24-2, respectively.

The switches 22-1 to 22-4 of the clock extracting switch group 22 are supplied respectively with shift pulses Vs1 to Vs4 outputted sequentially from the shift stages 21-1 to 21-4 of the shift register 21. When the shift pulses Vs1 to Vs4 have been delivered from the shift stages 21-1 to 21-4 of the shift register 21, the switches 22-1 to 22-4 of the clock extracting switch group 22 are turned on sequentially in response to the shift pulses Vs1 to Vs4, thereby extracting the clock pulses DCK2 and DCK1 of mutually opposite phases alternately.

The sampling switch group 23 is composed of four switches 23-1 to 23-4 corresponding to the pixel columns of the pixel array 15, wherein one end of each of the switches 23-1 to 23-4 is connected to the video line 25 to which the video signal Video is inputted. The switches 23-1 to 23-4 of the sampling switch group 23 are supplied respectively with the clock pulses DCK2 and DCK1, which have been extracted by the switches 22-1 to 22-4 of the clock extracting switch group 22, as sampling pulses Vh1 to Vh4.

When the sampling pulses Vh1 to Vh4 have been delivered from the switches 22-1 to 22-4 of the clock extracting switch group 22, the switches 23-1 to 23-4 of the sampling switch group 23 are turned on sequentially in response to the sampling pulses Vh1 to Vh4, thereby sequentially sampling the video signal Video inputted via the video line 25 and then supplies the sampled signal to the signal lines 12-1 to 12-4 of the pixel array 15.

In the horizontal driving circuit 17 according to this embodiment of the above-described structure, the shift pulses Vs1 to Vs4 outputted sequentially from the shift register 21 are not used as sampling pulses Vh1 to Vh4, but a pair of clock pulses DCK2 and DCK1 are extracted alternately in synchronism with the sampling pulses Vh1 to Vh4, and such clock pulses DCK2 and DCK1 are used directly as sampling pulses Vh1 to Vh4, so that it becomes possible to suppress fluctuations of the sampling pulses Vh1 to Vh4. As a result, any ghost derived from fluctuations of the sampling pulses Vh1 to Vh4 can be eliminated.

Further differing from the related art wherein the sampling pulses Vh1 to Vh4 are obtained by extracting the horizontal clock pulses HCKX and HCK, which serve as a reference to the shift operation of the shift register 21, the horizontal driving circuit 17 of this embodiment is so contrived that clock pulses DCK2 and DCK1 being equal in period to but smaller in duty ratio than the horizontal clock pulses HCKX and HCK are generated separately, and such clock pulses DCK2 and DCK1 are extracted to be used as sampling pulses Vh1 to Vh4. Consequently, the following advantages effects are attainable.

Figure 9:
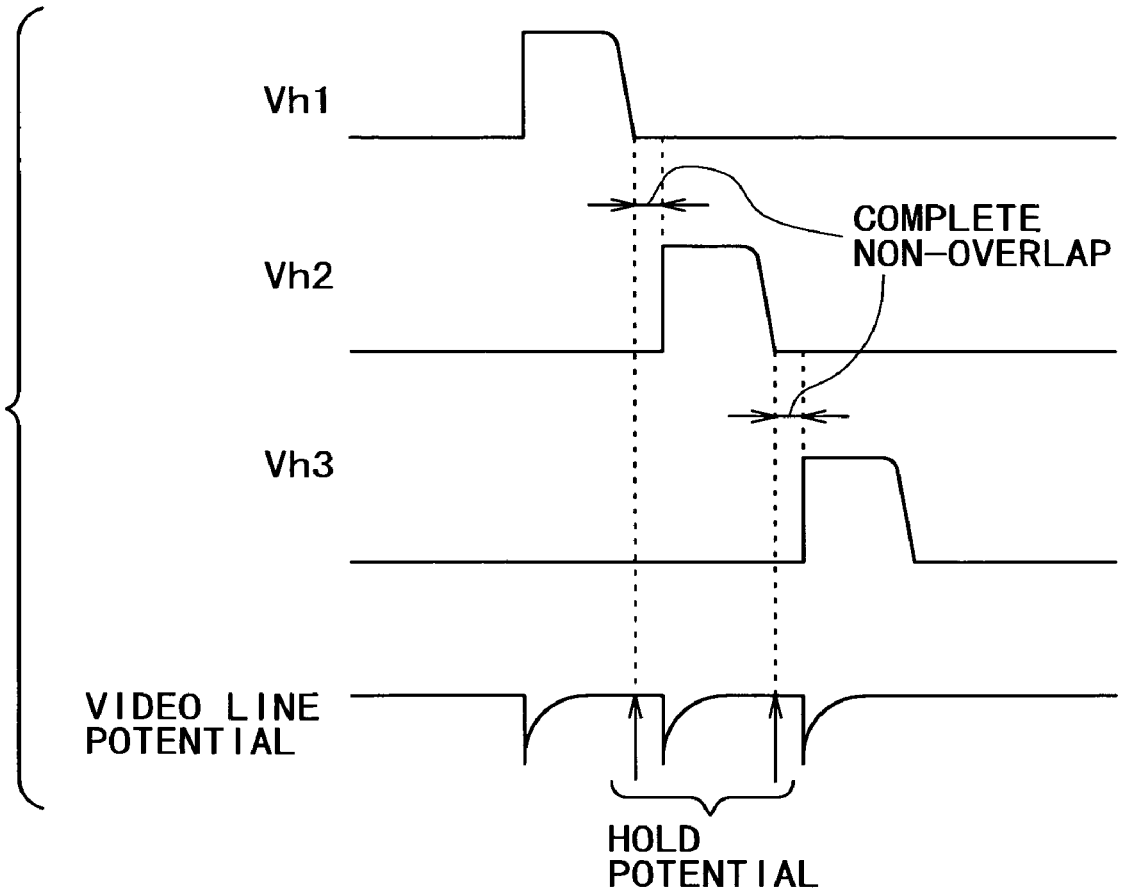
FIG. 9 is a timing chart during a video signal sampling operation performed in the clock drive type horizontal driving circuit according to the embodiment.

That is, in the process of transmission from extraction of the clock pulses DCK2 and DCK1 by the switches 22-1 to 22-4 of the clock extracting switch group 22 to delivery of such extracted pulses to the switches 23-1 to 23-4 of the sampling switch group 23, even if the pulses are somewhat delayed due to the wiring resistance, parasitic capacitance, or the like and the waveforms of the extracted clock pulses DCK2 and DCK1 are rounded, complete non-overlap waveforms are obtained between the extracted clock pulses DCK2, DCK1 and the preceding and following pulses respectively, as obvious especially from a timing chart of FIG. 9.

By using the clock pulses DCK2 and DCK1 of such complete non-overlap waveforms as sampling pulses Vh1 to Vh4, now with regard to the kth stage for example in the sampling switch group 23, the operation of sampling the video signal Video by the sampling switch of the kth stage can be finished without fail before the sampling switch of the k+1th stage is turned on.

Figure 8:
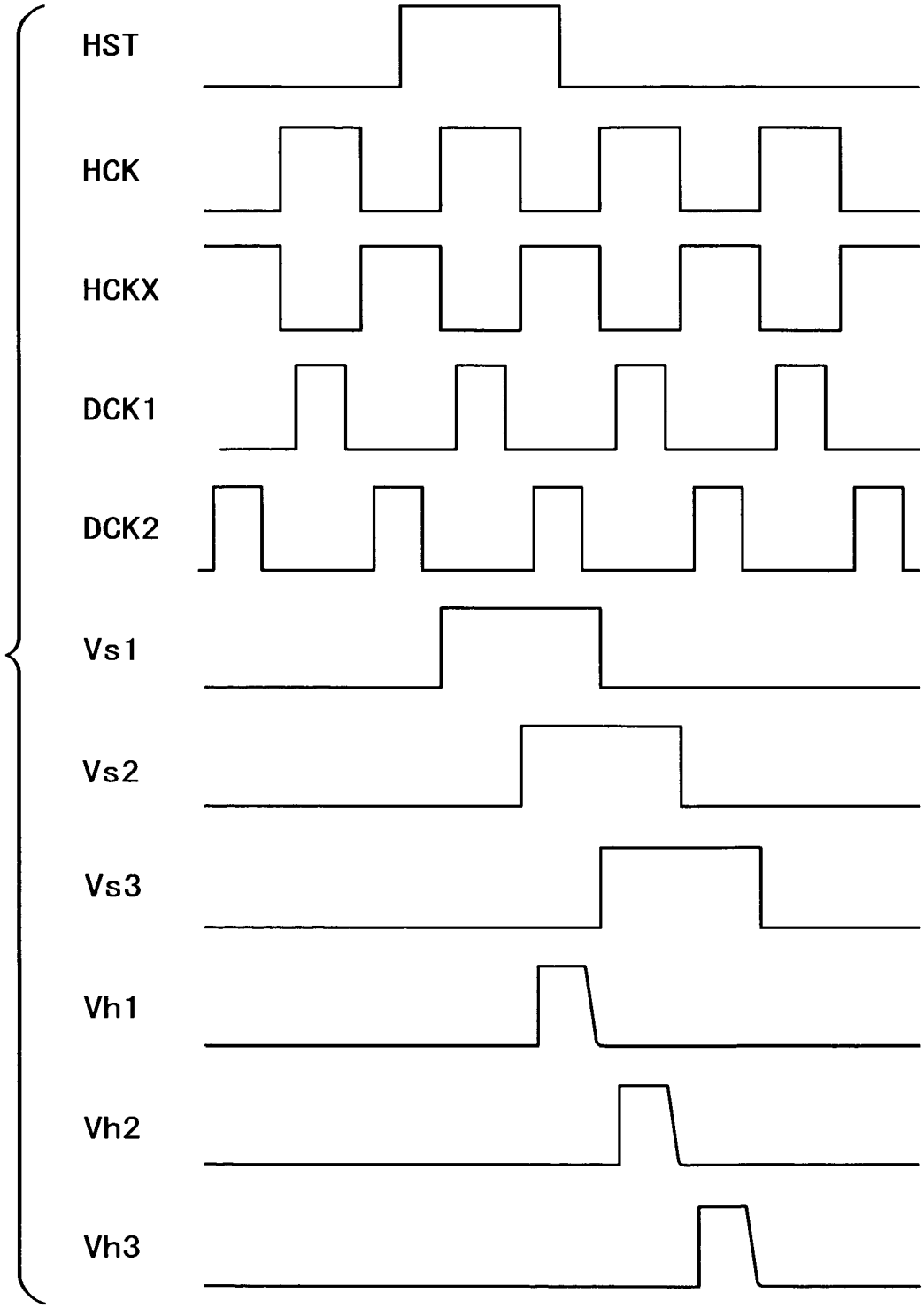
FIG. 8 is a timing chart for explaining the operation of a clock drive type horizontal driving circuit according to the embodiment of the invention.

Consequently, if a charge/discharge noise is superposed on the video line 25 at the moment any of the switches 23-1 to 23-4 of the sampling switch group 23 is turned on, as shown in FIG. 8, the sampling operation in the current stage (relevant stage immediately prior to the next stage) is performed without fail before occurrence of a charge/discharge noise by the next-stage switching, so that it becomes possible to prevent sampling of the charge/discharge noise. As a result, complete non-overlap sampling can be realized between the sampling pulses in the horizontal driving, hence suppressing appearance of vertical streaks that may otherwise be caused by overlap sampling.

Figure 10:
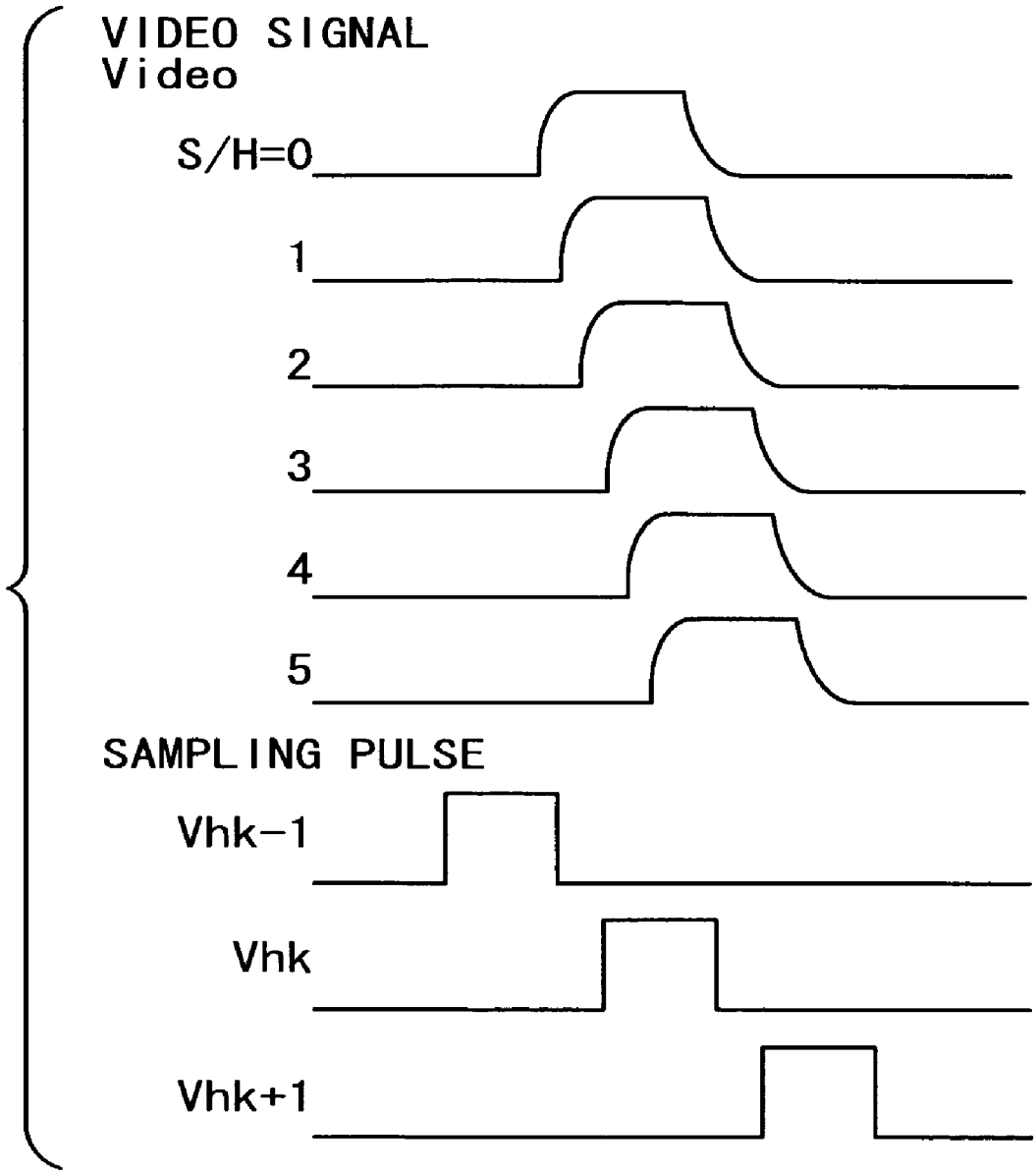
FIG. 10 is a timing chart showing the phase relationship between a video signal Video at sample-and-hold positions when S/H=0 to 5 and complete non-overlap sampling pulses Vhk−1, Vhk, and Vhk+1.

Since complete non-overlap sampling can thus be realized, a greater ghost margin free from occurrence of any ghost is attainable in comparison with the known value in the related art. Hereinafter a detailed description will be given on this point. FIG. 10 shows the phase relationship between a video signal Video at sample-and-hold positions when S/H=0 to 5 for example and complete non-overlap sampling pulses Vhk−1, Vhk, and Vhk+1.

Figure 11:
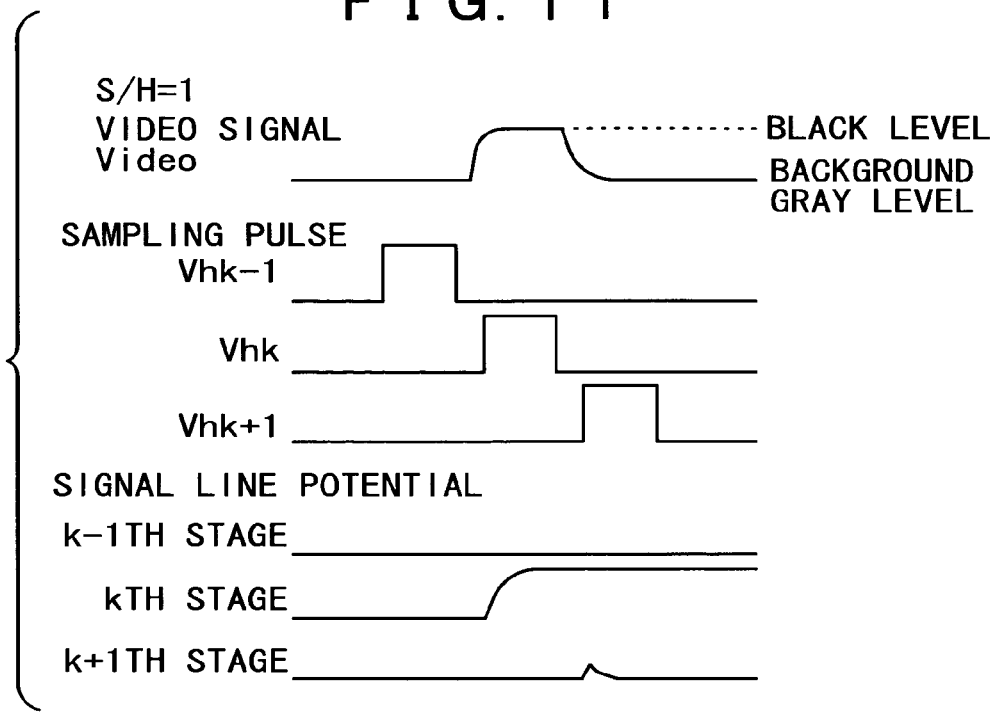
FIG. 11 is a timing chart showing the phase relationship between a video signal Video when S/H=1 and complete non-overlap sampling pulses Vhk−1, Vhk, and Vhk+1, and also showing potential changes on a signal line.

First, there is considered one case of S/H=1. FIG. 11 shows the phase relationship between the video signal Video when S/H=1 and the sampling pulses Vhk−1, Vhk, and Vhk+1, and also shows a potential change on the signal line. In the case of S/H=1, the sampling pulse Vhk−1 in the k−1th stage does not overlap with the black signal portion (pulse portion) of the video signal Video. Accordingly, when the pulse-shaped video signal Video has been sampled by the sampling pulse Vhk, the black signal is written merely in the kth-stage signal line alone, so that no ghost is caused at an anterior position in the horizontal scanning direction.

Figure 12:
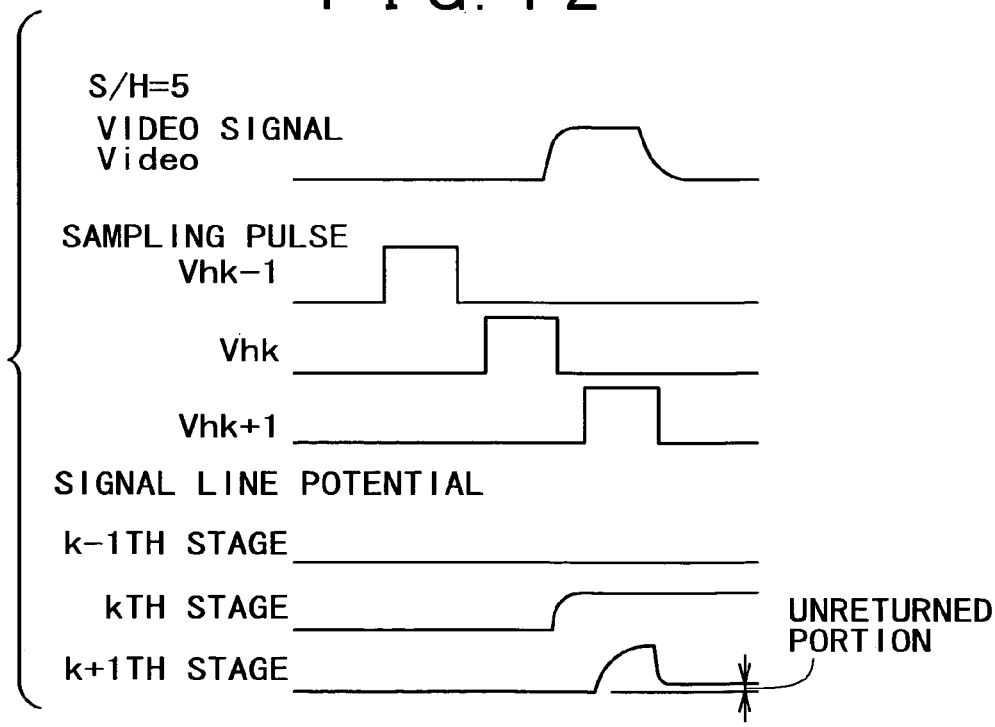
FIG. 12 is a timing chart showing the phase relationship between a video signal Video when S/H=5 and complete non-overlap sampling pulses Vhk−1, Vhk, and Vhk+1, and also showing potential changes on a signal line.

Next, there is considered another case of S/H=5. FIG. 12 shows the phase relationship between the video signal Video when S/H=5 and the sampling pulses Vhk−1, Vhk, and Vhk+1, and also shows a potential change on the signal line. In the case of S/H=5, the video black signal overlaps with the sampling pulse Vhk+1 of the k+1th stage. Consequently, the black signal is written in the signal line of the k+1th stage when the sampling switch is turned on, and then the potential level is lowered to return to the gray level. However, since the amount of overlap is great, the signal line potential fails to return completely to the gray level. Therefore, a ghost is caused at a posterior position in the horizontal scanning direction.

In any other case of S/H=1 to 4, as in the above-described case of S/H=5, the video black signal overlaps with the sampling pulse Vhk+1 of the k+1th stage, and the black signal is written in the signal line when the sampling switch is turned on. However, since the amount of overlap is smaller and the written black level is lower in comparison with the above case of S/H=5, the signal line potential returns completely down to the gray level. Consequently, no ghost is caused at a posterior position in the horizontal scanning direction.

As the sampling pulses Vhk−1, Vhk, and Vhk+1 thus overlap with one another, overlap sampling is performed in the related art. In comparison with such related art where the ghost margin is three in total inclusive of S/H=2, 3, 4, the ghost margin attainable in this embodiment that adopts the complete non-overlap sampling method increases to five in total since two states inclusive of S/H=0, 1 are added to the known states of S/H=2, 3, 4, whereby the ghost margin can be raised.

Regarding the above embodiment, a description has been given on an exemplary case of applying the present invention to a liquid crystal display device equipped with an analog interface driving circuit, which samples an input analog video signal and then drives the pixels dot sequentially. However, the invention is applicable also to a liquid crystal display device equipped with a digital interface driving circuit, which latches an input digital video signal, then converts the latched signal into an analog video signal and, after sampling the analog video signal, drives the pixels dot sequentially.

Also in the above embodiment, a description has been given on an example of applying the invention to an active matrix type liquid crystal display device where liquid crystal cells are used as display elements (electro-optical elements) in the pixels. However, the application of the invention is not limited to such a liquid crystal display device alone, and it may be applicable generally to any of active matrix type display devices based on a dot sequential driving system where a clock drive method is adopted for its horizontal driving circuit, such as an active matrix type EL display device employing electroluminescence (EL) elements as display elements in the pixels.

As for the dot sequential driving system, besides the conventional 1H inverse driving system and dot inverse driving system known heretofore, there is a dot-line inverse driving system wherein video signals of mutually inverse polarities are written simultaneously in the pixels of two rows spaced apart by an odd number of rows from each other between adjacent pixel columns, e.g., in the pixels of two upper and lower rows, in such a manner that, in the pixel array after writing of the video signals, the polarities become the same in the mutually adjacent left and right pixels but inverse in the upper and lower pixels.

Figure 13:
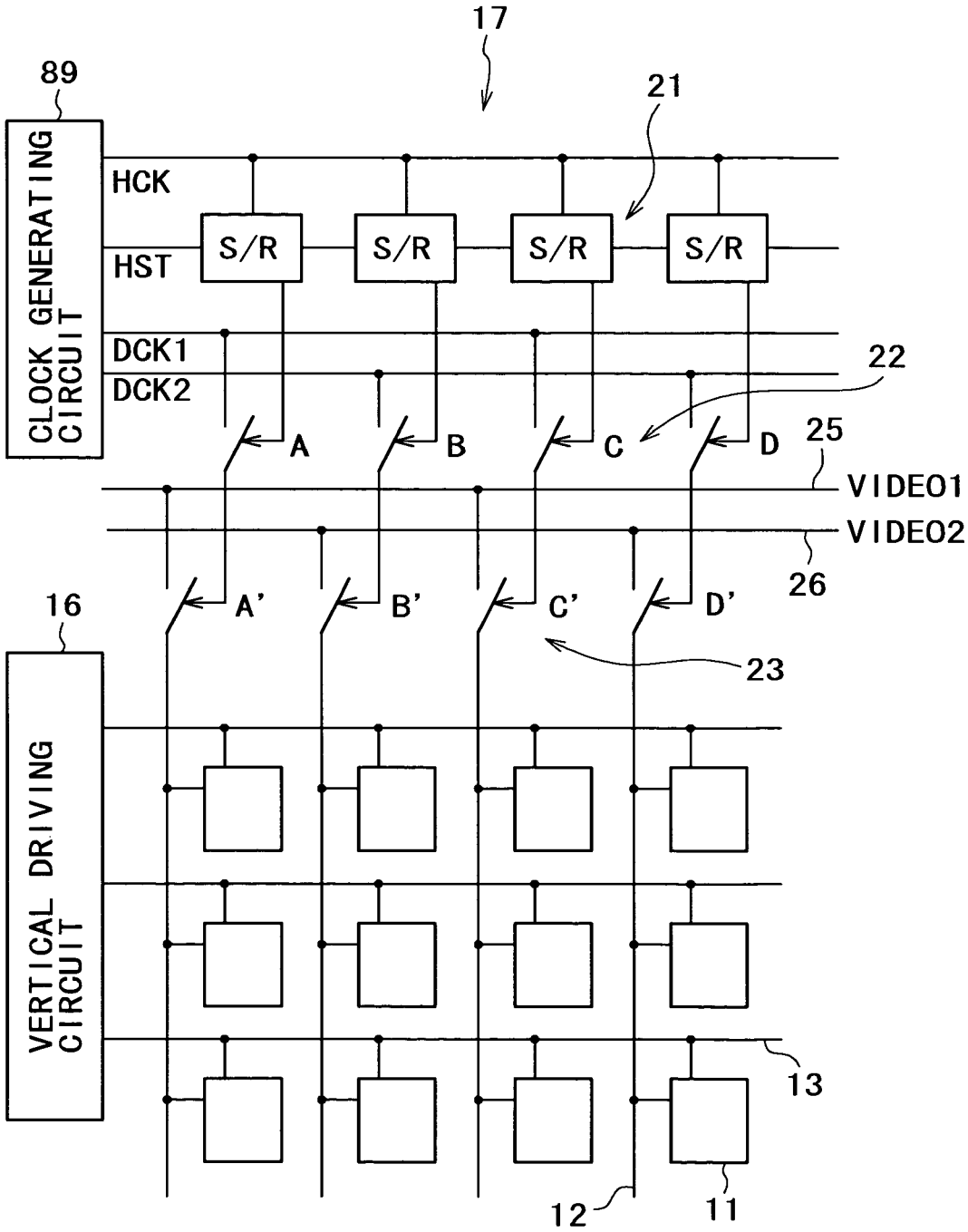
FIG. 13 is a block diagram showing a fundamental structure of a display device related to the second aspect of the present invention.

FIG. 13 is a typical block diagram showing another embodiment of a display device related to the second aspect of the present invention. As shown, this display device includes a panel having gate lines 13 in rows, signal lines 12 in columns, pixels 11 arrayed to form a matrix in the intersections of such gate and signal lines, and two video lines 25 and 26 for separately supplying video signals Video 1 and Video 2, which have a predetermined phase relationship and are divided into two routes. Although video signals of two routes are used in this embodiment, it is generally possible to use video signals of n routes having a predetermined phase relationship. In such a case, n video lines may be provided, wherein n is an integer greater than two. This display device further includes, in addition to the panel mentioned above, a vertical driving circuit 16, a horizontal driving circuit 17, and a clock generating means 89. Preferably, the vertical driving circuit 16 and the horizontal driving circuit 17 are incorporated in the panel. Further, a sampling switch group 23 is also formed in the panel. Each switch of the sampling switch group 23 is disposed correspondingly to each signal line 12 and is connected between the two video lines in units of two signal lines. More specifically, the switch corresponding to the first signal line is connected to one video line 25, while the switch corresponding to the second signal line is connected to the other video line 26. Thus, the signal lines 12 are connected alternately to the two video lines 25 and 26. In general, the sampling switch group 23 is connected between the n video lines in units of n signal lines.

The vertical driving circuit 16 is connected to each gate line 13 and selects the pixels 11 row by row sequentially. The horizontal driving circuit 17 operates in accordance with a clock signal of a predetermined period and sequentially generates sampling pulses A, B, C, D, . . . and so forth, which are not overlapped with respect to the switches of the sampling switch group 23 connected to the same video line but are overlapped with respect to the adjacent switches, thereby driving the switches in sequence to write the video signals Video 1 and Video 2 sequentially in the pixels 11 of the selected row.

A characteristic item of the present invention resides in that the clock generating means 89 generates a first clock signal HCK used as a reference to the operation of the horizontal driving circuit 17 and also generates second clock signals DCK1 and DCK2 each having a pulse width longer than that of the first clock signal HCK. The horizontal driving circuit 17 is composed of a shift register 21 and an extracting switch group 22. Each stage of the shift register 21 is denoted by S/R here. The shift register 21 shifts the horizontal start pulse HST synchronously with the first clock signal HCK and outputs shift pulses A, B, C, D, . . . and so forth sequentially from the respective shift stages S/R. The start pulse HST is supplied from the clock generating means 89. The respective switches of the extracting switch group 22 extract the second clock signals DCK1 and DCK2 in response to the shift pulses A, B, C, D, . . . and so forth outputted sequentially from the shift register 21 and produce the aforementioned sampling pulses A', B', C', D', . . . and so forth. In this manner, the horizontal driving circuit 17 sequentially generates sampling pulses, which are not overlapped with respect to the switches of the sampling switch group 23 connected to the same video line but are overlapped with respect to the adjacent switches, thereby driving the switches in sequence. For example, the sampling pulses A' and B' overlap with each other, while the pulses A' and C' do not overlap completely with each other.

Figure 14:
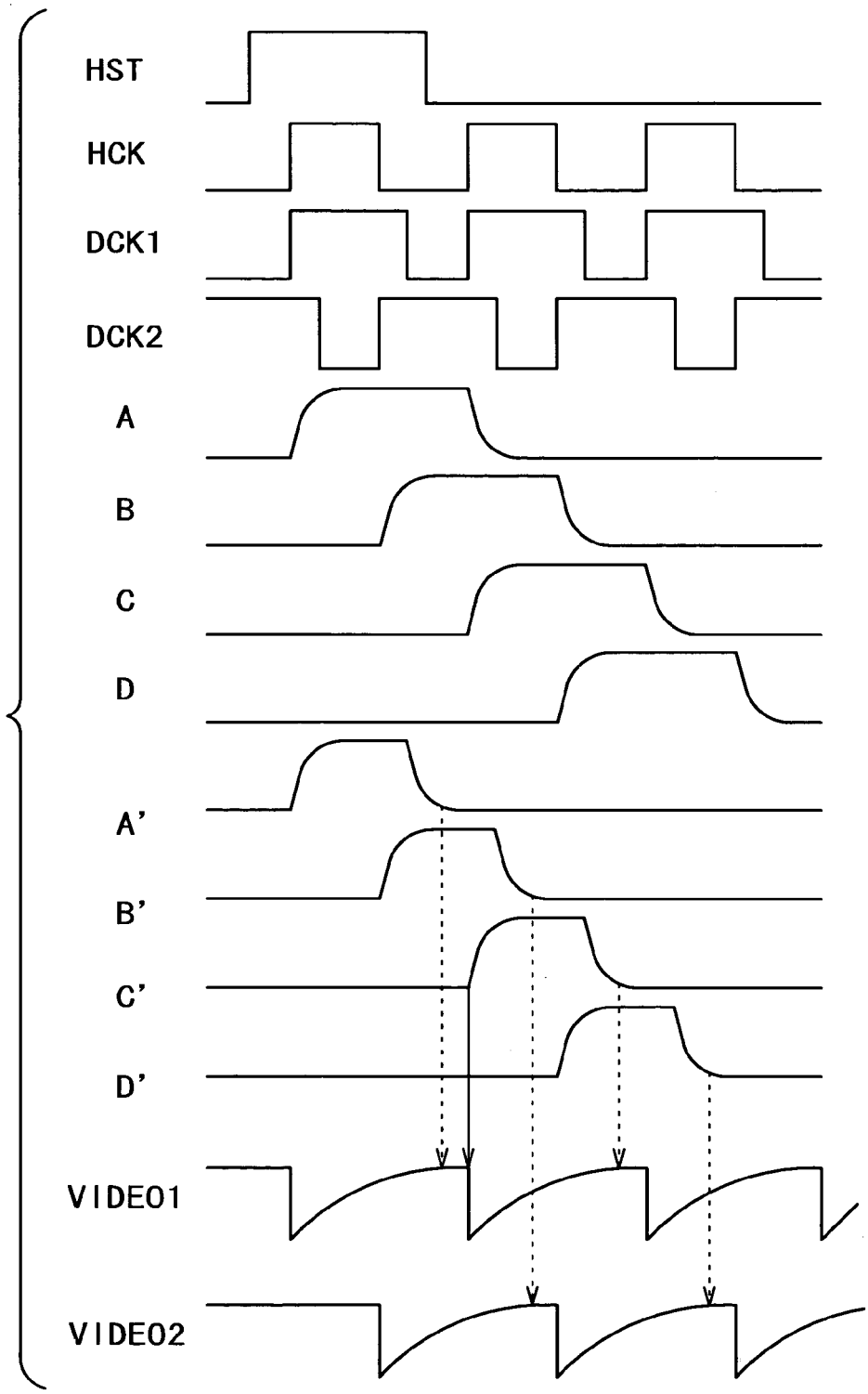
FIG. 14 is a waveform chart for explaining the operation of the display device shown in FIG. 13.

Referring to FIG. 14, an explanation will be given on the operation of the display device shown in FIG. 13. The horizontal driving circuit 17 operates in accordance with the first clock signal HCK (hereinafter referred to as HCK pulse in some case) and generates shift pulses A, B, C, D by sequentially transferring the start pulse HST. The clock generating means 89 supplies, in addition to the HCK pulse, second clock signals DCK1 and DCK2 (hereinafter referred to as DCK pulse in some case) to the horizontal driving circuit 17. As obvious from the timing chart of FIG. 14, the DCK pulse is equal in period to but greater in pulse width than the HCK pulse. DCK1 and DCK2 have a phase deviation of 180° C. from each other.

The horizontal driving circuit 17 shown in FIG. 13 turns on/off the extracting switch group 22 by the shift pulses A, B, C, D, . . . to extract DCK pulses, whereby sampling pulses A', B', C', D', . . . are generated. More specifically, a sampling pulse A' is generated by extracting the DCK1 pulse in accordance with the shift pulse A. Similarly, a sampling pulse B' is obtained by extracting the DCK2 pulse in accordance with the shift pulse B. Subsequently, sampling pulses C', D', . . . and so forth are obtained by extracting the DCK pulses similarly in accordance with the shift pulses. Due to introduction of such a clock drive method, it is rendered possible to keep overlap between the mutually adjacent sampling pulses and to attain complete non-overlap between the alternate signal lines connected to the same video line. For example, the sampling pulses A' and B' overlap with each other, while the pulses A' and C' do not overlap completely with each other.

Such complete non-overlap can cope with vertical streaks or ghosts peculiar to the active matrix type display device based on a dot sequential driving system. In the example of FIG. 14, when the sampling pulse A' has fallen for instance, the video signal Video1 is sampled properly on the corresponding signal line, as indicated by a dotted-line arrow. Thereafter, when the sampling pulse C' rises as indicated by a solid-line arrow, a charge/discharge is caused on the signal line, so that the potential of the video signal Video1 is varied downward to consequently superpose a noise. However, at the time point of occurrence of this noise, no harmful effect is exerted since the sampling pulse A' has already fallen.

As described, in the present invention, there is introduced a clock drive method that employs DCK pulses to execute divided sample-and-hold driving. In order to deal with the divided sample-and-hold driving, DCK pulses having a longer pulse width and a different duty ratio in comparison with the HCK pulses are used as those to be extracted by the clock drive. Since the DCK pulses are thus extracted by the shift pulses outputted from the respective stages of the shift register, the mutually adjacent sampling pulses are made to overlap with each other, while the sampling pulses corresponding to the same video line are made not to overlap with each other. In this manner, it becomes possible to eliminate vertical streaks in a checkered pattern obtained by dot-line inverse driving or in a specific pattern such as a one-dot horizontal line pattern obtained by dot-line inverse driving. It further becomes possible to simultaneously solve the problems of vertical streaks and ghosts peculiar to the dot-sequential active matrix display device.

Figure 15:
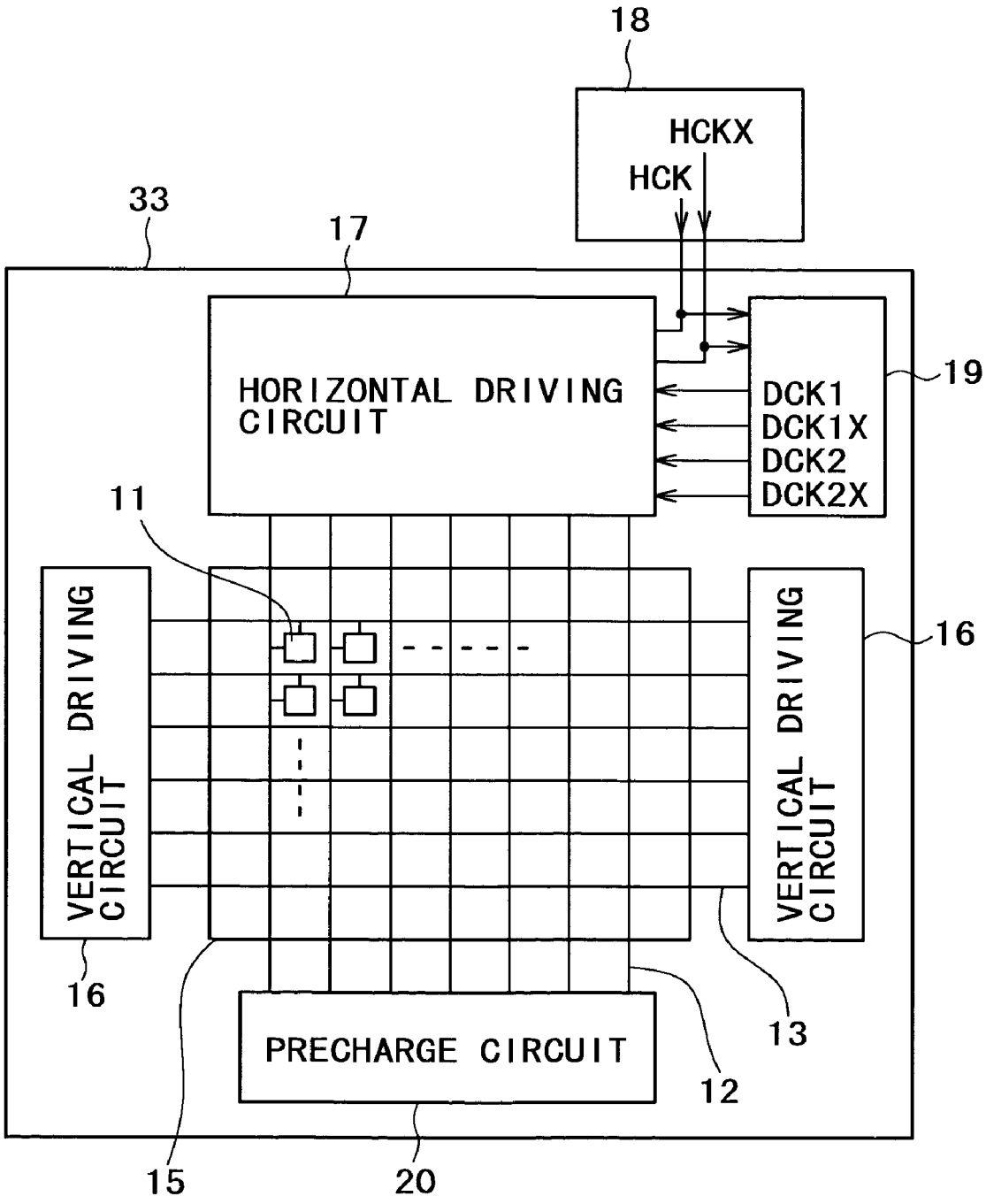
FIG. 15 is a block diagram showing a concrete structural example of the display device shown in FIG. 13.

FIG. 15 is a typical block diagram showing a concrete structural example of the display device according to the present invention. As shown, this display device is composed of a panel 33 where a pixel array 15, a vertical driving circuit 16, a horizontal driving circuit 17, and so forth are formed integrally. The pixel array 15 includes gate lines 13 in rows, signal lines 12 in columns, and pixels 11 arrayed to form a matrix in the intersections of such gate and signal lines. The vertical driving circuit 16 is disposed separately on the left and right and is connected to the two ends of each gate line 13 for selecting the row of the pixels 11 sequentially. The horizontal driving circuit 17 is connected to the signal lines 12 and operates in accordance with HCK pulses of a predetermined period in a manner to write a video signal sequentially in the pixels 11 of the selected row. This display device further has a clock generating means, which generates HCK pulses serving as a reference to the operation of the horizontal driving circuit 17 and also generates DCK pulses equal in period to but greater in pulse width than the HCK pulses. The HCK pulses include the clock signals HCK and HCKX. HCKX is an inverted signal of HCK. The DCK pulses include clock signals DCK1, DCK1X, DCK2, and DCK2X. DCK1X is an inverted signal of DCK1, and DCK2X is an inverted signal of DCK2. DCK1 and DCK2 have a phase deviation of 180° C. from each other. For the purpose of simplifying the diagram, video lines and a sampling switch group incorporated actually in the panel 33 are omitted here. Further, a precharge circuit 20 is connected to each signal line 12 and, prior to sampling the video signal from the horizontal driving circuit 17, applies a potential of a predetermined level to each signal line 12 previously to thereby improve the display definition.

A characteristic item of the this embodiment resides in that the clock generating means is divided into an external clock generating circuit 18 and an internal clock generating circuit 19. The external clock generating circuit 18 is provided on a driving system board (not shown) disposed outside the panel 33 and supplies the first clock signals HCK and HCKX externally to the internal horizontal driving circuit 17. Meanwhile the internal clock generating circuit 19 is formed in the panel 33 together with the vertical driving circuit 16 and the horizontal driving circuit 17. The circuit 19 generates the second clock signals DCK1, DCK1X, DCK2, and DCK2X internally and then supplies these signals to the horizontal driving circuit 17. The internal clock generating circuit 19 generates DCK pulses by processing the HCK pulses supplied thereto from the external clock generating circuit 18. An increase of the number of input pads formed in the panel 33 can be prevented by producing the DCK pulses within the panel. Assuming that the entire HCK and DCK pulses are supplied externally, a total of six input pads are required. In this embodiment, four input pads can be curtailed by producing the DCK pulses within the panel.

Figure 16:
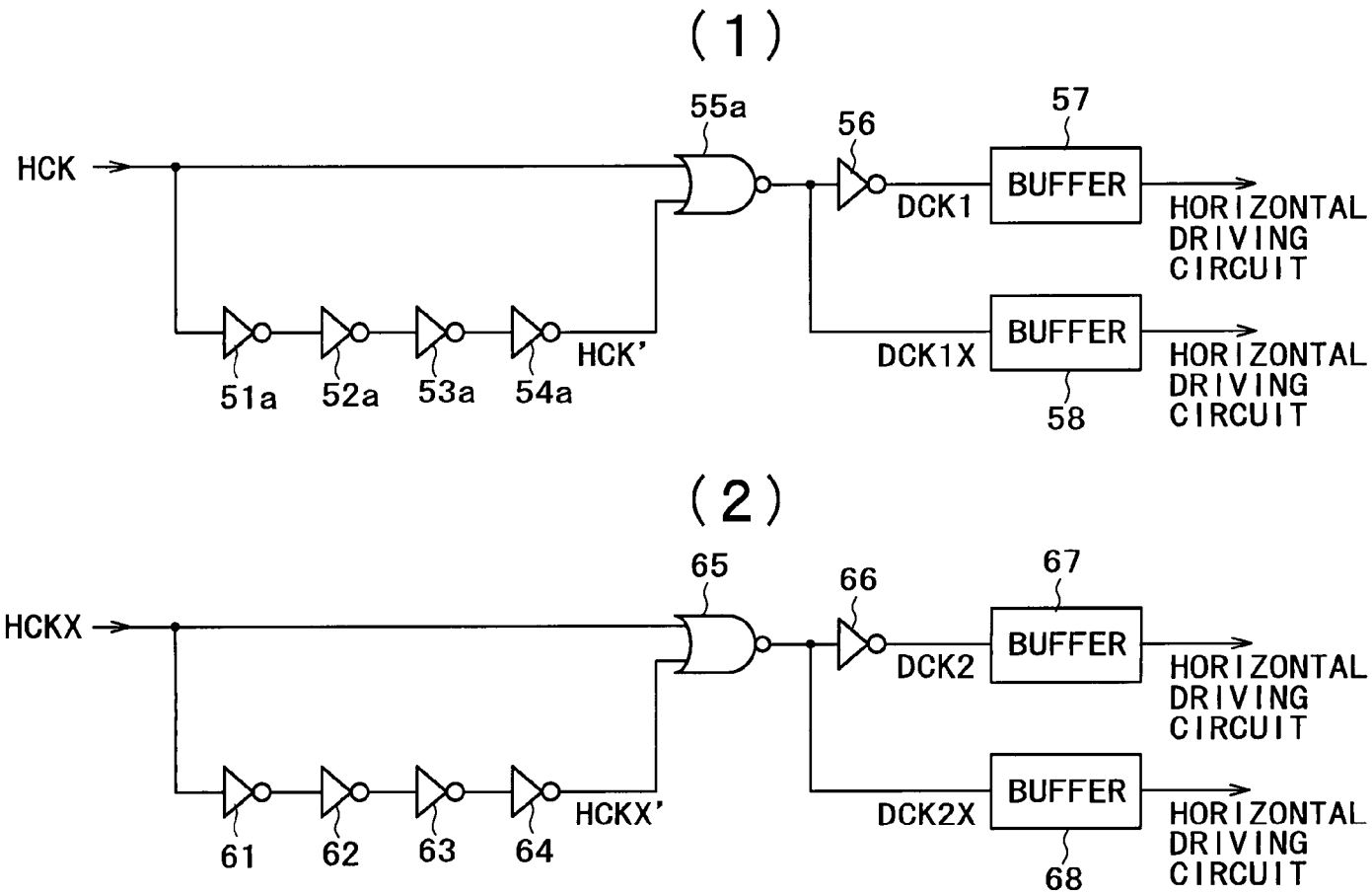
FIG. 16 is a block diagram showing a concrete structural example of an internal clock generating circuit incorporated in the display device of FIG. 15.

FIG. 16 is a block diagram showing a concrete structural example of the internal clock generating circuit 19 shown in FIG. 15. Viewing now the first route (1), the first clock signal HCK supplied from the external clock generating circuit is divided into two. One is supplied directly to one input terminal of a NOR circuit 55*a*, while the other is supplied to a delay circuit composed of four inverters 51*a* to 54*a* connected in series. The output of the delay circuit is supplied to the other input terminal of the NOR circuit 55*a*. In this manner, the non-delayed signal HCK and the delayed signal HCK' are NOR-processed in the NOR circuit 55*a*. The signal outputted from the NOR circuit 55*a* is inverted by an inverter 56 and then is outputted as a clock signal DCK1 via a buffer 57. The signal obtained from the output terminal of the NOR circuit 55*a* is branched and outputted via a buffer 58 as DCK1X, which is then sent to the horizontal driving circuit. It is generally known that a pulse signal delays whenever passing through an inverter. In this embodiment, therefore, the clock signal HCK' having passed through a plurality of inverters delays by several tens of nanoseconds in comparison with the clock signal HCK having not passed through any inverter. These two clock signals HCK and HCK' are NOR-processed to consequently produce desired clock signals DCK1 and DCK1X each being greater in pulse width than the signal HCK. Similarly to the above, DCK2 and DCK2X are generated in the route (2).

Figure 17:
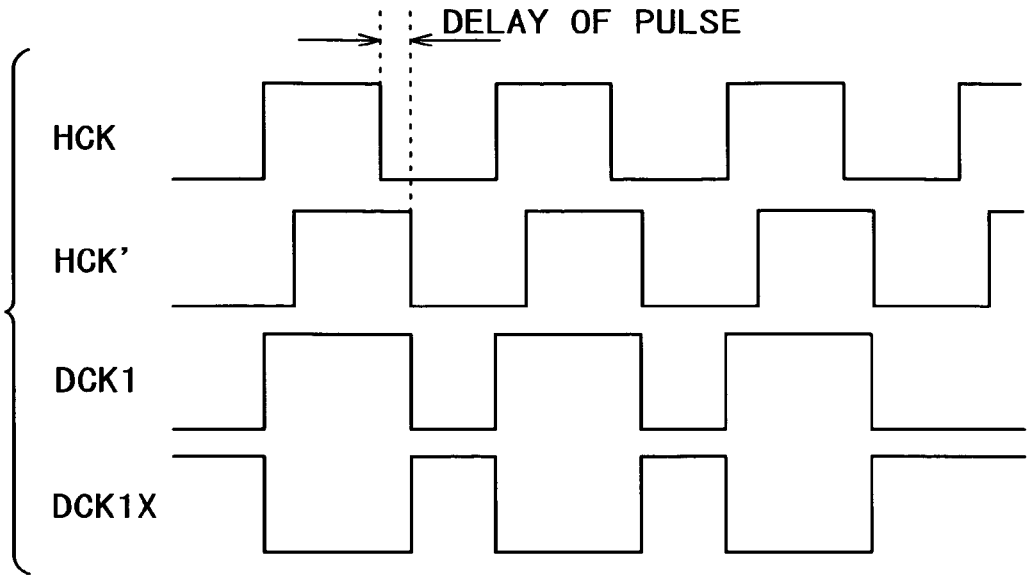
FIG. 17 is a timing chart for explaining the operation of the internal clock generating circuit shown in FIG. 16.
Figure 17:
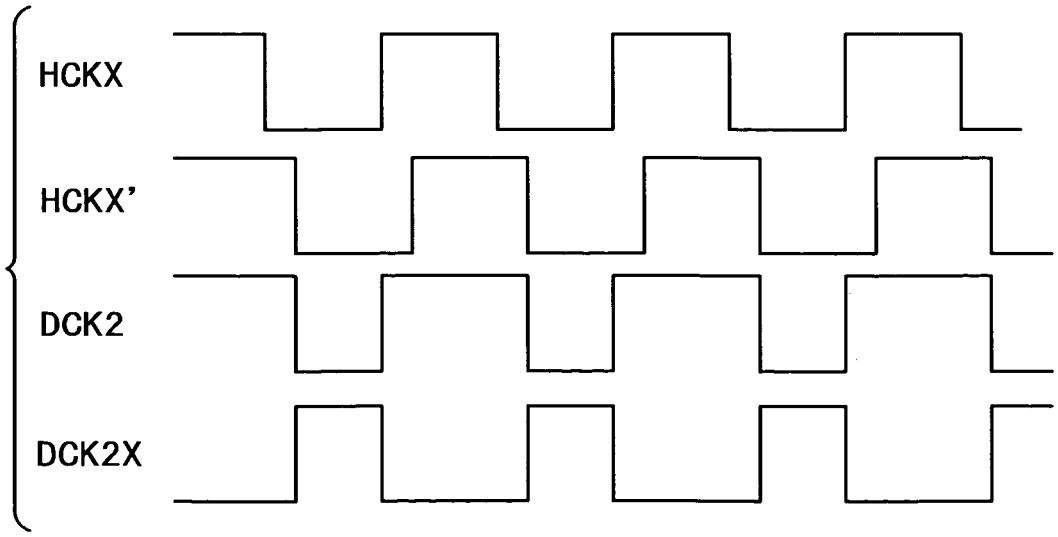

FIG. 17 is a waveform chart for explaining the operation of the internal clock generating circuit shown in FIG. 16. In FIG. 17, (1) represents the operation of the first route (1) shown in FIG. 16, and (2) represents the operation of the second route (2) shown in FIG. 16. Viewing FIG. 17 (1) now, HCK' has a delay of a predetermined time as compared with HCK. This delay amount is optimally settable by the number of stages of the series-connected inverters. A signal DCK1X having an extended pulse width can be obtained by NOR-processing the pulses HCK and HCK', which are deviated mutually in phase through the delay process. A signal DCK1 is obtained by inverting DCK1X by means of the output inverter. Similarly, as shown in FIG. 17 (2), a signal DCK2 is obtained through mutual logical processing of the non-delayed signal HCKX and the delayed signal HCKX'. A signal DCK2X is obtained by inverting the signal DCK2.

Figure 18:
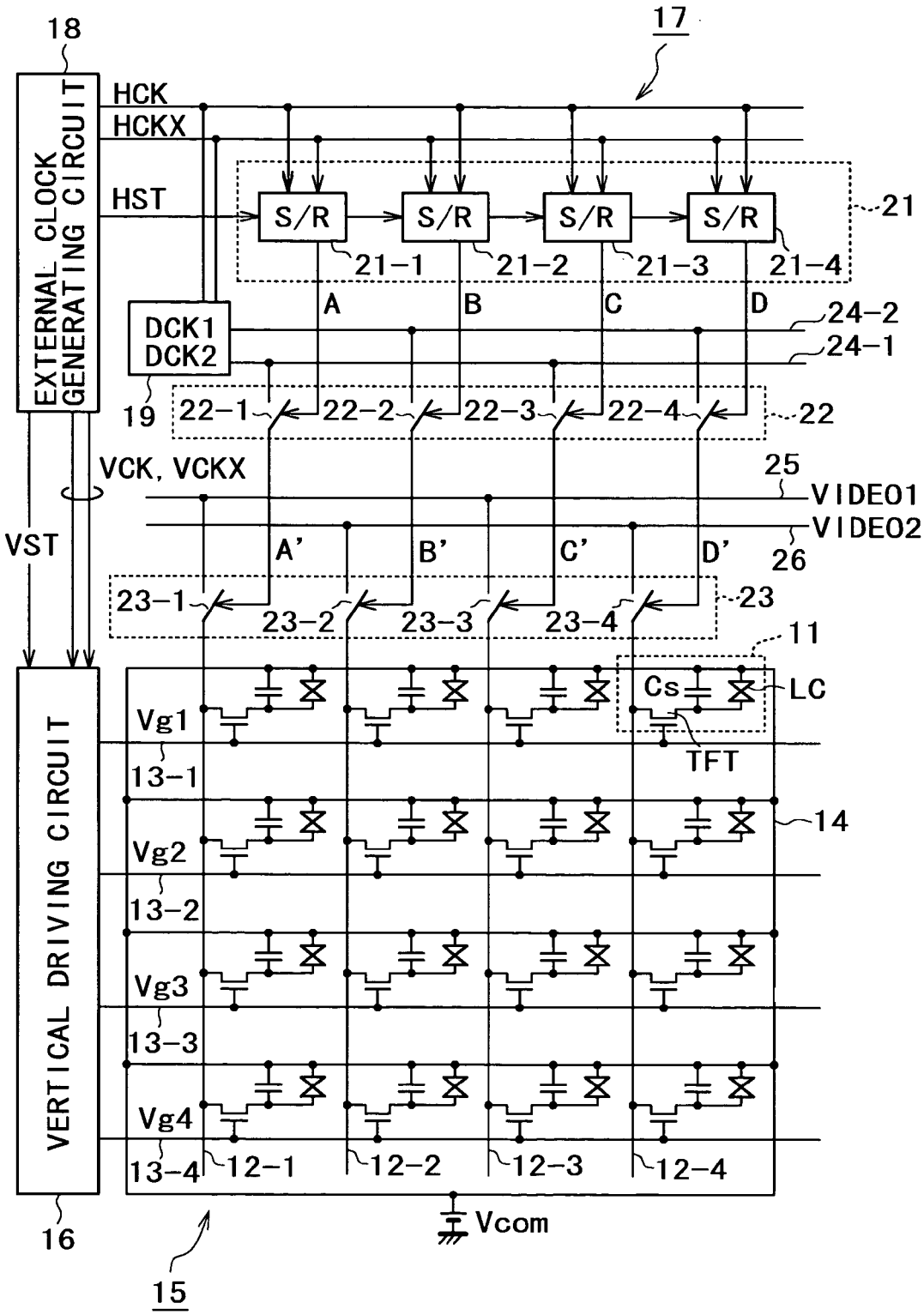
FIG. 18 is a circuit diagram showing a structural example of an active matrix type liquid crystal display device based on a dot sequential driving system according to an embodiment of the present invention.
Figure 19:
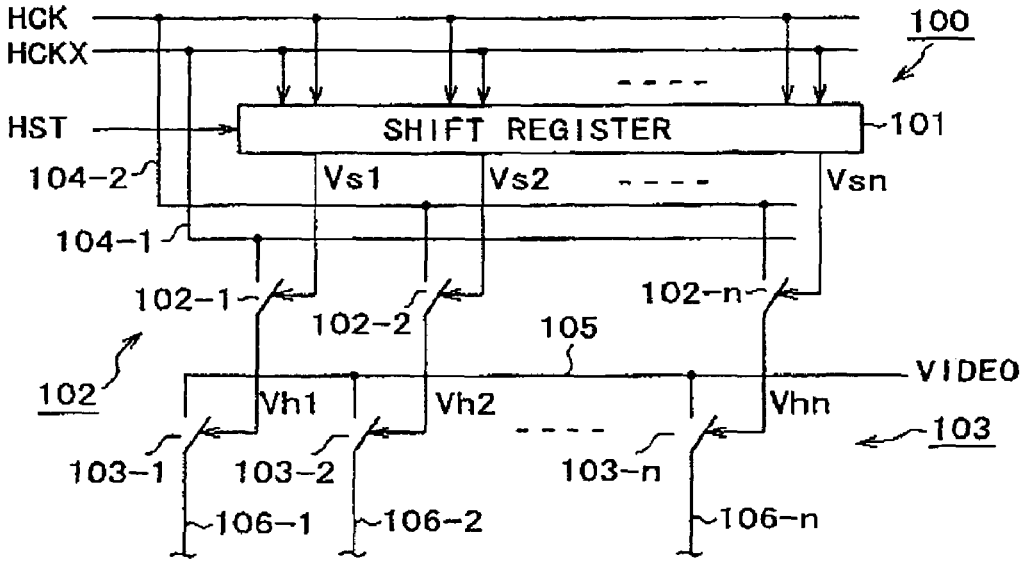
PRIOR ART F I G. 1 9
FIG. 19 is a block diagram showing a structural example of a conventional clock drive type horizontal driving circuit.
Figure 20:
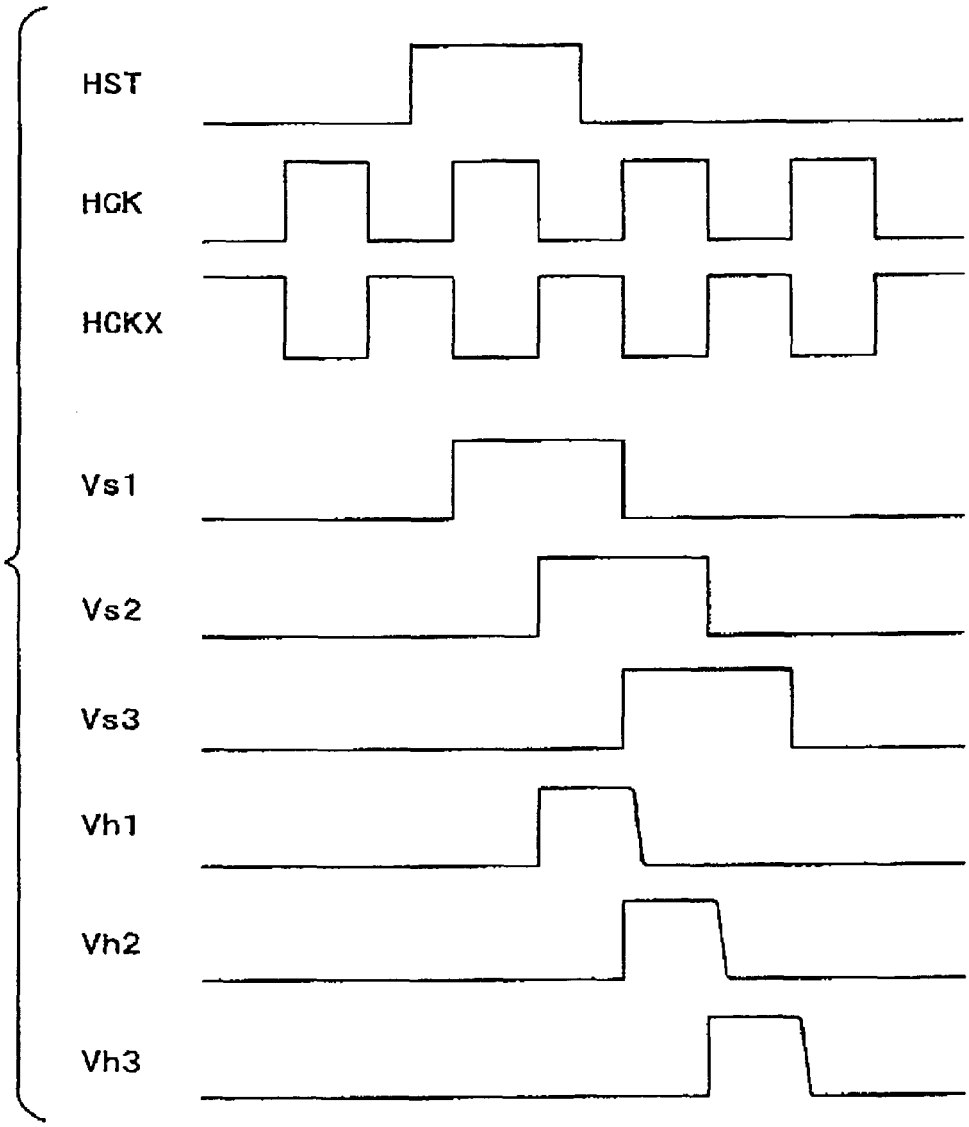
PRIOR ART FIG. 20
FIG. 20 is a timing chart for explaining the operation of the conventional clock drive type horizontal driving circuit.
Figure 21:
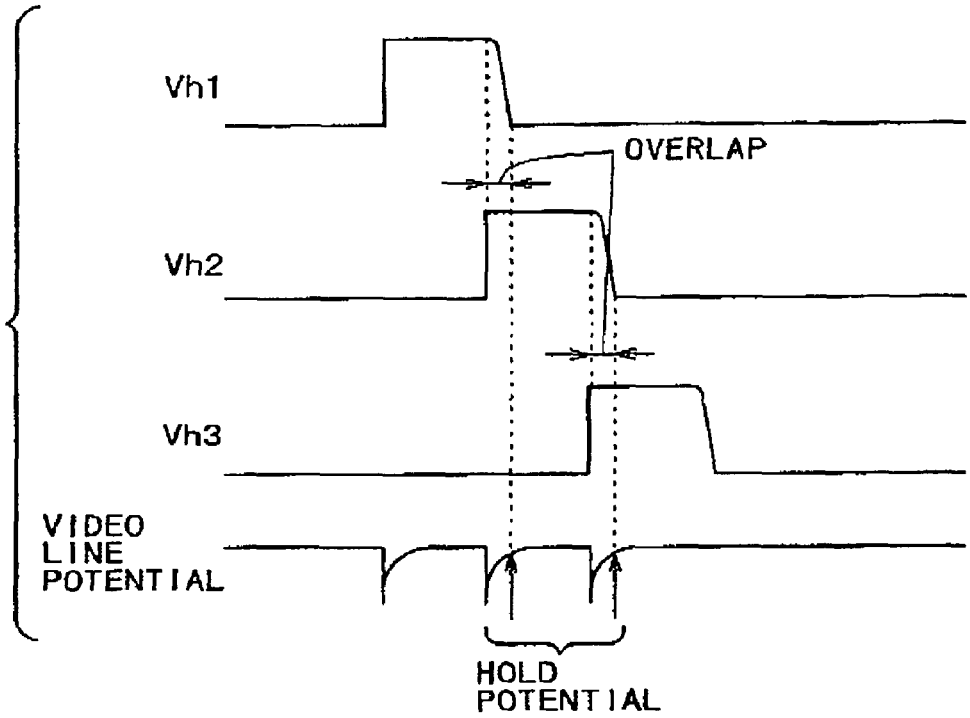
PRIOR ART FIG. 21
FIG. 21 is a timing chart during a video signal sampling operation performed in the conventional clock drive type horizontal driving circuit.
Figure 22:
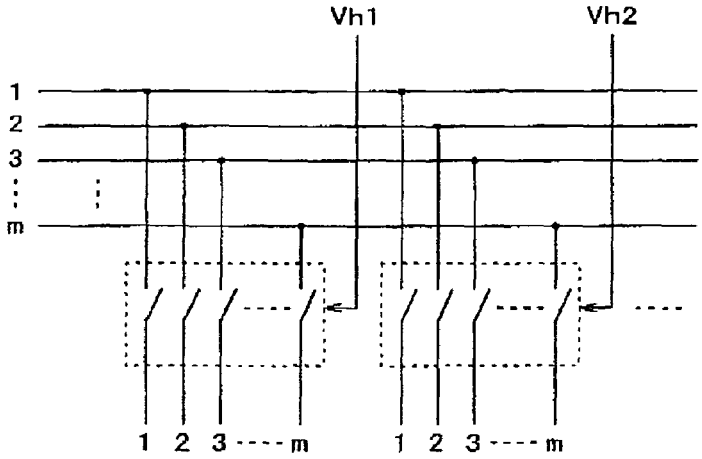
PRIOR ART FIG. 22
FIG. 22 is a diagram showing a structure of a sampling switch group when a video signal is inputted in parallel through m routes.
Figure 23:
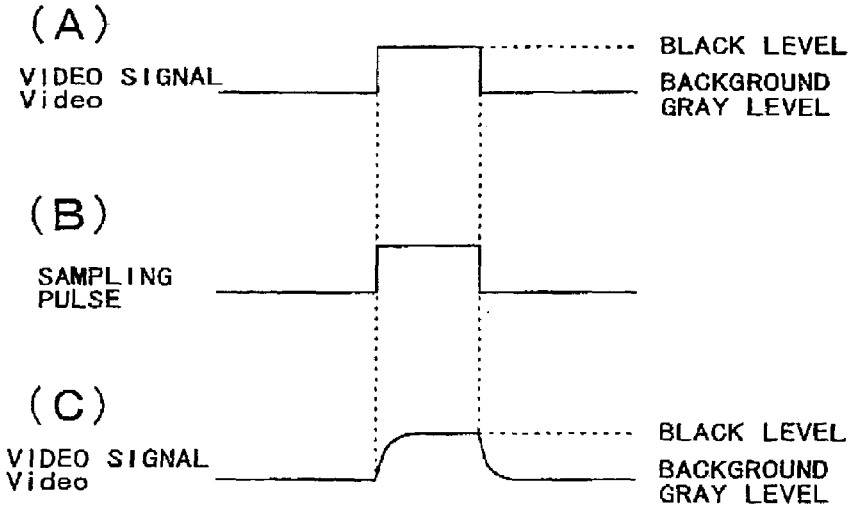
PRIOR ART FIG. 23
FIG. 23 is a waveform chart showing a state where a pulse-shaped video signal is rounded.
Figure 24:
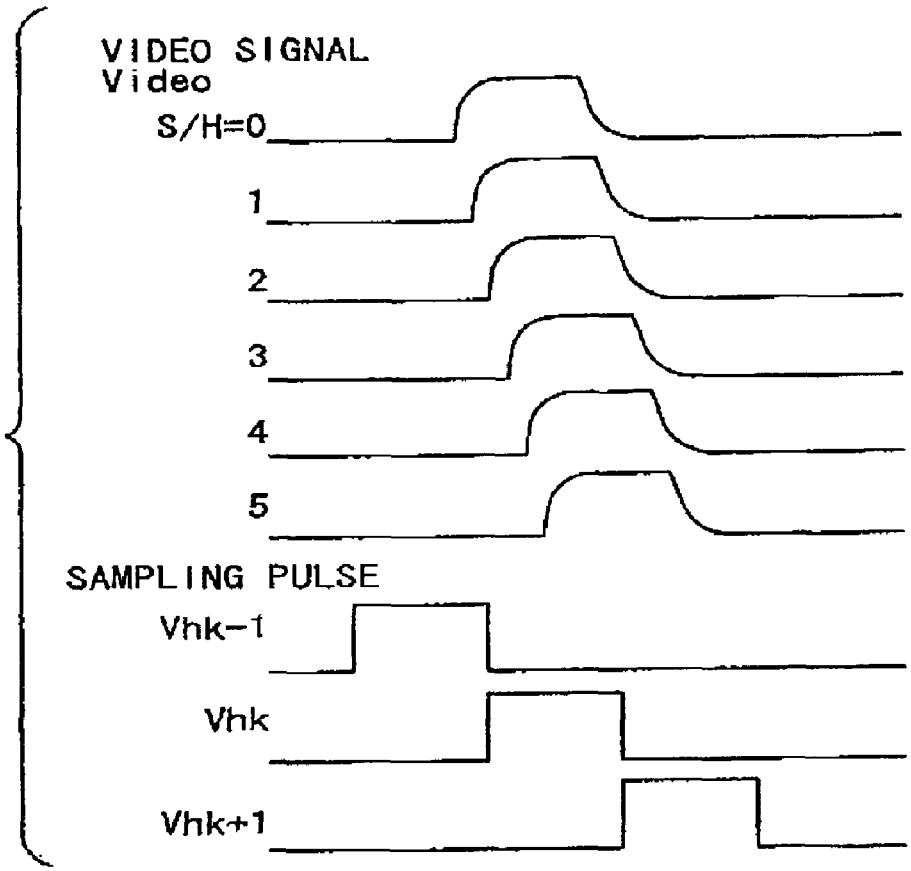
PRIOR ART FIG. 24
FIG. 24 is a timing chart showing the phase relationship between a video signal Video at sample-and-hold positions when S/H=0 to 5 and complete non-overlap sampling pulses Vhk−1, Vhk, and Vhk+1.
Figure 25:
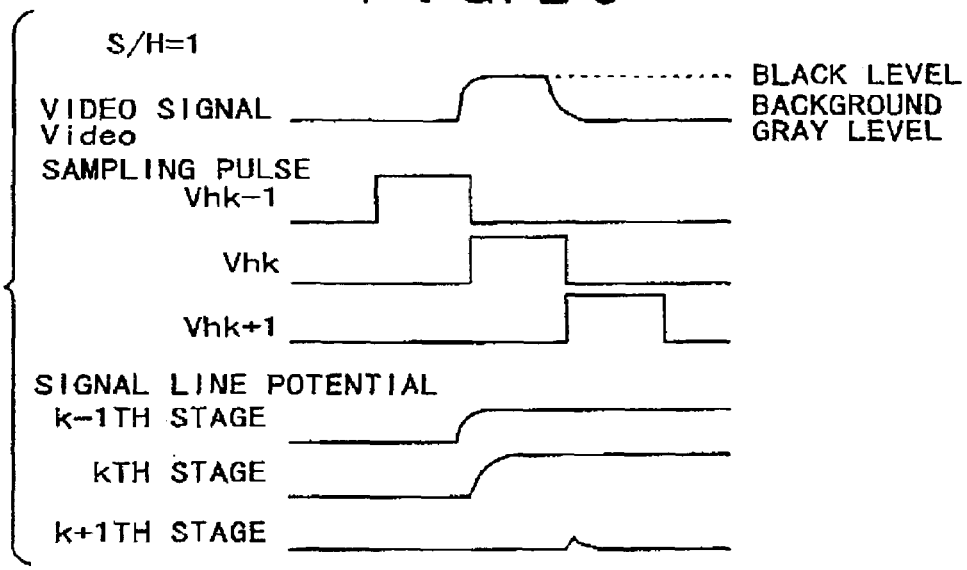
PRIOR ART FIG. 25
FIG. 25 is a timing chart showing the phase relationship between a video signal Video when S/H=1 and complete non-overlap sampling pulses Vhk−1, Vhk, and Vhk+1, and also showing potential changes on a signal line.
Figure 26:
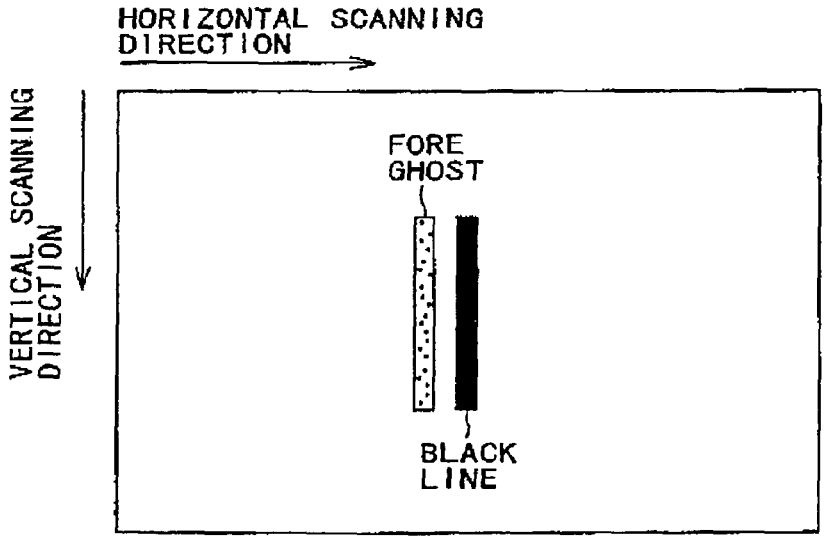
PRIOR ART FIG. 26
FIG. 26 is a diagram showing a state where a fore ghost is caused anteriorly in the horizontal scanning direction.
Figure 27:
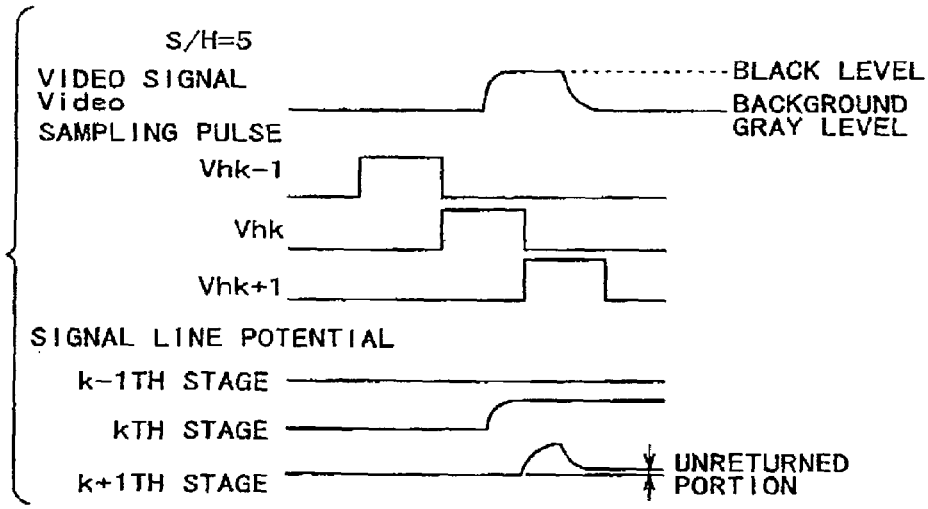
PRIOR ART FIG. 27
FIG. 27 is a timing chart showing the phase relationship between a video signal Video when S/H=5 and complete non-overlap sampling pulses Vhk−1, Vhk, and Vhk+1, and also showing potential changes on a signal line.
Figure 28:
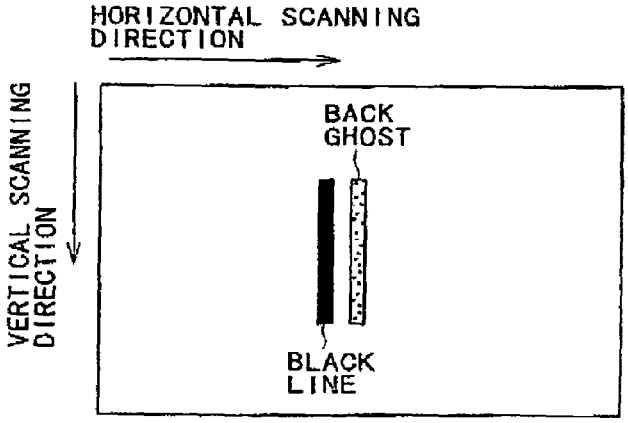
PRIOR ART FIG. 28
FIG. 28 is a diagram showing a state where a back ghost is caused posteiorly in the horizontal scanning direction.
Figure 29:
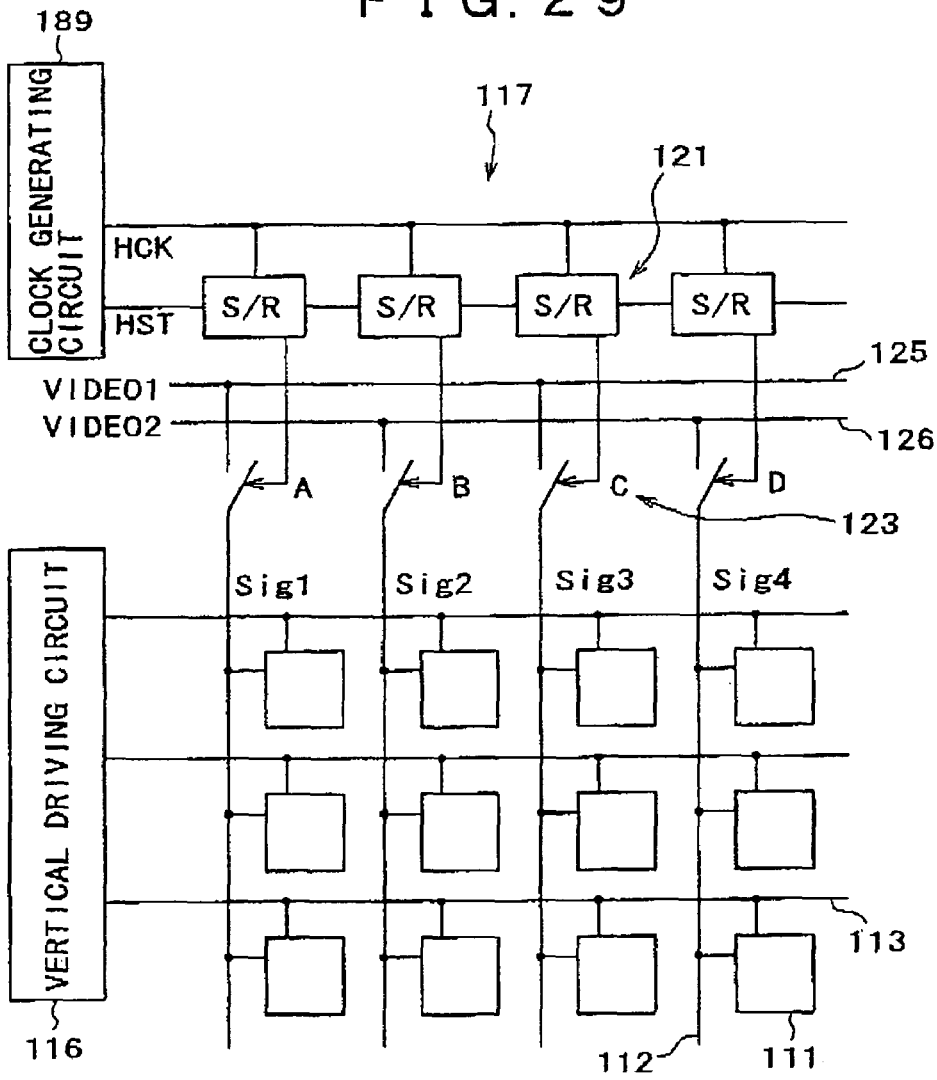
PRIOR ART FIG. 29
FIG. 29 is a block diagram showing an example of a conventional display device.
Figure 30:
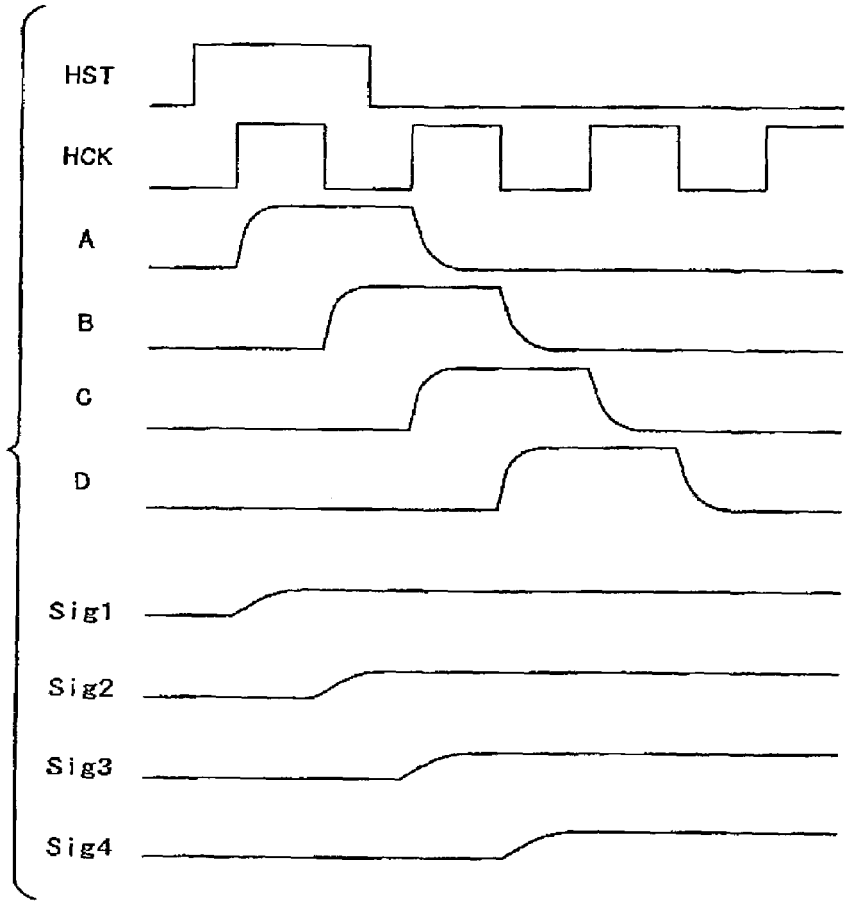
PRIOR ART FIG. 30
FIG. 30 is a waveform chart for explaining the operation of the conventional display device shown in FIG. 29.
Figure 31:
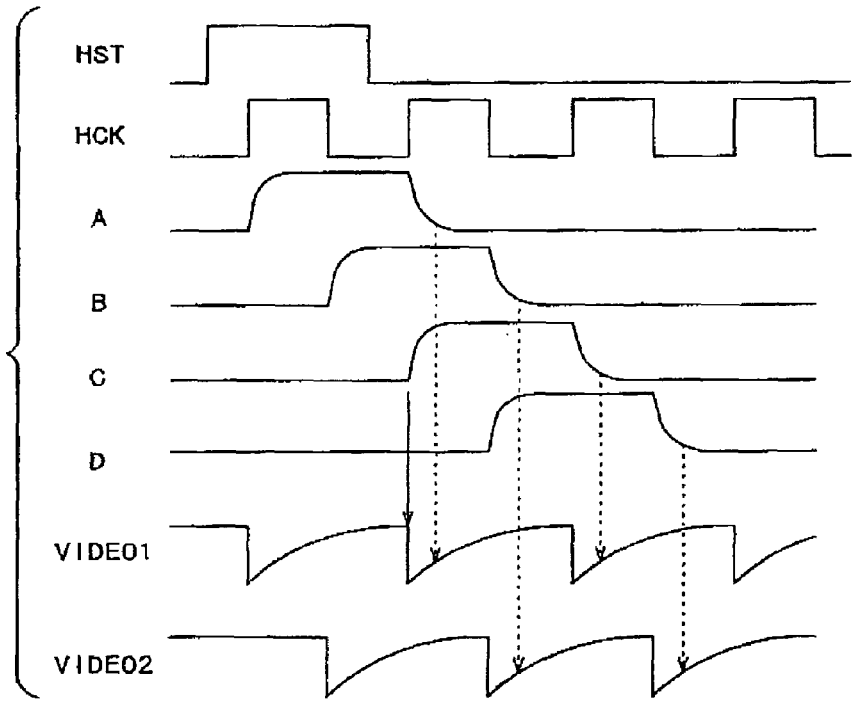
PRIOR ART FIG. 31
FIG. 31 is another waveform chart for explaining the operation of the conventional display device shown in FIG. 29.

FIG. 18 is a circuit diagram showing a structural example of an active matrix type liquid crystal display device based on a dot sequential driving system according to an embodiment of the present invention where liquid crystal cells for example are used as display elements (electro-optical elements) of pixels. For the purpose of simplifying the diagram, there is shown here an exemplary case of a pixel array with four rows and four columns. In an active matrix type liquid crystal display device, it is usual that a thin film transistor (TFT) is used as a switching element of each pixel.

In FIG. 18, each of the four-row four-column pixels 11 arrayed to form a matrix includes a thin film transistor TFT serving as a pixel transistor a liquid crystal cell LC where a pixel electrode is connected to a drain electrode of the thin film transistor TFT, and a hold capacitance Cs of which one electrode is connected to the drain electrode of the thin film transistor TFT. With respect to such pixels 11, signal lines 12-1 to 12-4 are wired column by column in the pixel array direction, and gate lines 13-1 to 13-4 are wired row by row in the pixel array direction.

In each of the pixels 11, the source electrode (or drain electrode) of the thin film transistor TFT is connected the corresponding one of the signal lines 12-1 to 12-4. The gate electrode of the thin film transistor TFT is connected to the gate lines 13-1 to 13-4 respectively. The counter electrode of the liquid crystal cell LC and the other electrode of the hold capacitance Cs are connected to a Cs line 14 in common between the pixels. A predetermined DC voltage is applied as a common voltage Vcom to the Cs line 14.

Thus, there is structured a pixel array 15 where the pixels 11 are arrayed to form a matrix, the signal lines 12-1 to 12-4 are wired column by column with respect to the pixels 11, and the gate lines 13-1 to 13-4 are wired row by row. In this pixel array 15, one end of each of the gate lines 13-1 to 13-4 is connected to the output terminal of the corresponding stage of a vertical driving circuit 16 disposed, for example, on the left of the pixel array 15.

The vertical driving circuit 16 performs vertical scanning (in the row direction) per field and sequentially selects, row by row, the pixels 11 connected to the gate lines 13-1 to 13-4.

More specifically, when a scanning pulse Vg1 is delivered from the vertical driving circuit 16 to the gate line 13-1, the pixels of the respective columns on the first row are selected. When a scanning pulse Vg2 is delivered to the gate line 13-2, the pixels of the respective columns on the second row are selected. Similarly, scanning pulses Vg3 and Vg4 are delivered sequentially to the gate lines 13-3 and 13-4.

A horizontal driving circuit 17 is disposed, for example, above the pixel array 15. And an external clock generating circuit (timing generator) 18 is provided for supplying various clock signals to the vertical driving circuit 16 and the horizontal driving circuit 17. This external clock generating circuit 18 generates a vertical start pulse VST to instruct start of vertical scanning, vertical clock pulses VCK and VCKX having mutually opposite phases and used as a reference to vertical scanning, a vertical start pulse HST to instruct start of horizontal scanning, and horizontal clock pulses HCK and HCKX of mutually opposite phases serving as a reference to the horizontal scanning.

An internal clock generating circuit 19 is provided separately from the external clock generating circuit 18. The internal clock generating circuit 19 generates pairs of clock pulses DCK1 and DCK2, which are equal in period to but greater in pulse width than the horizontal clock pulses HCK and HCKX.

The horizontal driving circuit 17 sequentially samples video signals Video1 and Video2, which are inputted from two video lines 25 and 26, per horizontal scanning interval (1H), and writes the sampled signals in the pixels 11 of the row selected by the vertical driving circuit 16. In this embodiment, the horizontal driving circuit 17 is formed by adopting a clock drive method and includes a shift register 21, a clock extracting switch group 22, and a sampling switch group 23.

The shift register 21 is composed of four shift stages (S/R) 21-1 to 21-4 corresponding to the pixel columns (four columns in this embodiment) of the pixel array 15. In response to a horizontal start pulse HST, the shift register 21 performs a shift operation synchronously with the horizontal clock pulses HCK and HCKX having mutually opposite phases. Consequently, shift pulses A to D having a pulse width equal to the period of the horizontal clock pulses HCK and HCKX are outputted sequentially from the shift stages 21-1 to 21-4 of the shift register 21.

The clock extracting switch group 22 is composed of four switches 22-1 to 22-4 corresponding to the pixel columns of the pixel array 15, wherein one end of each of such switches 22-1 to 22-4 is connected alternately to clock lines 24-1 and 24-2 through which the clock pulses DCK2 and DCK1 are transmitted from the internal clock generating circuit 19. That is, one end of each of the switches 22-1 and 22-3 is connected to the clock line 24-1, and one end of each of the switches 22-2 and 22-4 is connected to the clock line 24-2, respectively.

The switches 22-1 to 22-4 of the clock extracting switch group 22 are supplied respectively with shift pulses A to D outputted sequentially from the shift stages 21-1 to 21-4 of the shift register 21. When the shift pulses A to D have been delivered from the shift stages 21-1 to 21-4 of the shift register 21, the switches 22-1 to 22-4 of the clock extracting switch group 22 are turned on sequentially in response to the shift pulses A to D, thereby extracting the clock pulses DCK2 and DCK1 of mutually opposite phases alternately.

The sampling switch group 23 is composed of four switches 23-1 to 23-4 corresponding to the pixel columns of the pixel array 15, wherein one end of each of the switches 23-1 to 23-4 is connected alternately to the video line 25 for inputting the video signal Video1 and to the video line 26 for inputting the video signal Video2. The switches 23-1 to 23-4 of the sampling switch group 23 are supplied respectively with the clock pulses DCK2 and DCK1, which have been extracted by the switches 22-1 to 22-4 of the clock extracting switch group 22, as sampling pulses A' to D'.

When the sampling pulses A' to D' have been delivered from the switches 22-1 to 22-4 of the clock extracting switch group 22, the switches 23-1 to 23-4 of the sampling switch group 23 are turned on sequentially in response to the sampling pulses A' to D', thereby sequentially and alternately sampling the video signals Video1 and Video2 inputted via the video line 25 and 26, and then supplies the sampled signals to the signal lines 12-1 to 12-4 of the pixel array 15.

In the horizontal driving circuit 17 according to this embodiment of the above-described structure, the shift pulses A to b outputted sequentially from the shift register 21 are not used directly as sampling pulses A' to D', but a pair of clock pulses DCK2 and DCK1 are extracted alternately in synchronism with the shift pulses A to D, and such clock pulses DCK2 and DCK1 are used as sampling pulses A' to D'. Therefore, it becomes possible to suppress fluctuations of the sampling pulses A' to D'. As a result, any ghost derived from fluctuations of the sampling pulses A' to D' can be eliminated.

INDUSTRIAL AVAILABILITY

As described hereinabove, according to the first aspect of the present invention in an active matrix type display device based on a dot sequential driving system, there is employed, in horizontal driving performed by a clock drive method, a second clock signal, which is equal in period to but smaller in duty ratio than a first clock signal serving as a reference to horizontal scanning, and such second clock signal is extracted and used as a sampling pulse to sample a video signal, so that complete non-overlap sampling can be realized to consequently suppress occurrence of vertical streaks that may otherwise be caused by overlap sampling, and further the ghost margin can be raised. Particularly according to the present invention, the first clock signal is produced internally by processing the second clock signal supplied externally. Therefore, it becomes possible to minimize an increase in the number of terminals and the number of wirings to be formed in the panel. Moreover, since the second clock signal is supplied externally, the pulse width thereof is freely adjustable to an optimal value. Consequently, an optimal DCK pulse width can be obtained with regard to any quality deterioration derived from vertical steaks and also to the ghost margin as well.

According to the second aspect of the present invention, clock drive is performed by the use of DCK pulses, which are longer in pulse width than and are different in duty ratio from the HCK pulses serving as a reference to the operation of the horizontal driving circuit. As a result, complete non-overlap sampling that complies with divided sample-and-hold driving can be achieved to eventually suppress occurrence of any vertical streak or ghost. And simultaneously, sampling pulses assigned to mutually adjacent signal lines in the divided sample-and-hold driving are overlapped with each other, hence realizing elimination of vertical streaks, which may appear at the time of displaying a dot checkered pattern in a line inverse driving mode or a one-dot horizontal line pattern in a dot-line inverse driving mode. In addition, the DCK pulses can be produced within the panel on the basis of the HCK pulses supplied externally, thereby preventing an increase in the number of input pads or in the number of input wirings.

The invention claimed is:

1. A display device comprising:

a panel having gate lines in rows, signal lines in columns, and pixels arrayed to form a matrix in the intersections of such rows and columns;

a vertical driving circuit connected to said gate lines and selecting the row of the pixels sequentially;

a horizontal driving circuit connected to said signal lines and, in response to a clock signal of a predetermined period, writing a video signal sequentially in the pixels of the selected row; and a clock generating means for generating a first clock signal used as a reference to the operation of said horizontal driving circuit, and also generating a second clock signal equal in period to but smaller in duty ratio than the first clock signal;

wherein said horizontal driving circuit has a shift register for outputting shift pulses sequentially from respective shift stages thereof by performing a shift operation synchronously with the first clock signal; a first switch group for extracting the second clock signal in response to the shift pulses outputted sequentially from said shift register; and a second switch group for sampling the input video signal sequentially in response to the second clock signal extracted by the switches of said first switch group, and supplying the sampled signal to each signal line;

and said clock generating means is divided into an external clock generating circuit disposed outside the panel and supplying the second clock signal externally, and an internal clock generating circuit formed within the panel and supplying the first clock signal to said horizontal driving circuit in accordance with the second clock signal; and wherein said external clock generating circuit is capable of variably adjusting the duty ratio of the second clock signal.

2. The display device according to claim 1, wherein said internal clock generating circuit includes a D type flip-flop for generating the first clock signal by processing the second clock signal supplied thereto from said external clock generating circuit.

3. The display device according to claim 2, wherein said D type flip-flop is composed of a plurality of NAND elements.

4. A display device comprising:

a panel having gate lines in rows, signal lines in columns, pixels arrayed to form a matrix in the intersections of such rows and columns, and n video lines for supplying video signals separated into n routes (where n is an integer greater than two) in a predetermined phase relationship;

a vertical driving circuit connected to said gate lines and selecting the row of the pixels sequentially;

a sampling switch group disposed correspondingly to each signal line and connected between the n video lines in units of n signal lines;

a horizontal driving circuit operating in accordance wit a clock signal of a predetermined period, and sequentially generating sampling pulses, which are not overlapped with respect to the switches of said sampling switch group connected to the same video line but are overlapped with respect to the adjacent switches, and driving the switches sequentially to thereby write the video signal sequentially in the pixels of the selected row; and a clock generating means for generating a first clock signal used as a reference to the operation of said horizontal driving circuit, and also generating a second clock signal longer in pulse width than the first clock signal;

wherein said horizontal driving circuit has a shift register for outputting shift pulses sequentially from respective shift stages thereof by performing a shift operation synchronously with the first clock signal; and an extracting switch group for sequentially generating the sampling pulses by extracting the second clock signal in response to the shift pulses outputted sequentially from said shift register, and said clock generating means is divided into an external clock generating circuit disposed outside the panel and supplying the first clock signal externally to said horizontal driving circuit, and an internal clock generating circuit formed within the panel and supplying the second clock signal internally to said horizontal driving circuit.

5. The display device according to claim 4, wherein said internal clock generating circuit generates the second clock signal by processing the first clock signal supplied from said external clock generating circuit.

6. The display device according to claim 5, wherein said internal clock generating circuit includes a delay circuit for delaying the first clock signal, and generates the second clock signal out of the first clock signal prior to the delay process and the first clock signal posterior to the delay process.

7. The display device according to claim 6, wherein said delay circuit is composed of an even number of inverters connected in series.

8. The display device according to claim 7, wherein said internal clock generating circuit has a NOR circuit for generating the second clock signal by NOR-combining the first clock signal prior to the delay process with the first clock signal posterior to the delay process.

* * * * *